US011651728B2

(12) United States Patent
Sohn et al.

(10) Patent No.: US 11,651,728 B2
(45) Date of Patent: May 16, 2023

(54) PIXEL AND DISPLAY DEVICE INCLUDING THE SAME

(71) Applicant: Samsung Display Co., LTD., Yongin-si (KR)

(72) Inventors: Young Ha Sohn, Yongin-si (KR); Se Hyuk Park, Yongin-si (KR); Hae Kwan Seo, Yongin-si (KR); Jin Wook Yang, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/724,695

(22) Filed: Apr. 20, 2022

(65) Prior Publication Data

US 2023/0089661 A1 Mar. 23, 2023

(30) Foreign Application Priority Data

Sep. 17, 2021 (KR) ..... 10-2021-0125172

(51) Int. Cl.
*G09G 3/32* (2016.01)
*G09G 3/00* (2006.01)

(52) U.S. Cl.
CPC ..... *G09G 3/32* (2013.01); *G09G 3/006* (2013.01); *G09G 2300/0819* (2013.01); *G09G 2300/0842* (2013.01); *G09G 2300/0861* (2013.01); *G09G 2310/08* (2013.01); *G09G 2320/0295* (2013.01); *G09G 2320/045* (2013.01); *G09G 2330/021* (2013.01); *G09G 2330/12* (2013.01)

(58) Field of Classification Search
None
See application file for complete search history.

(56) References Cited

U.S. PATENT DOCUMENTS 7,209,102 B2 * 4/2007 Moon ..... G09G 3/3655 345/95
7,944,411 B2 * 5/2011 Saeki ..... G09G 3/3688 345/94
9,041,746 B2 * 5/2015 Byun ..... G09G 3/3233 345/690

(Continued)

FOREIGN PATENT DOCUMENTS

KR 10-0942503 2/2010
KR 10-2147401 8/2020
KR 10-2217889 2/2021

*Primary Examiner* — Michael J Jansen, II
(74) *Attorney, Agent, or Firm* — Kile Park Reed & Houtteman PLLC

(57) ABSTRACT

A pixel includes a light emitting element, a first transistor including a gate electrode electrically connected to a first node, a second transistor including a gate electrode connected to a first scan line, a third transistor including a gate electrode connected to the first scan line, a fourth transistor including a gate electrode connected to a second scan line, a fifth transistor including a gate electrode electrically connected to a third scan line, an sixth transistor including a gate electrode electrically connected to the third scan line, a resistor electrically connected in parallel with the sixth transistor between the second node and the anode of the light emitting element, and an amplifier having a non-inverting terminal and an inverting terminal electrically connected to ends of the resistor, respectively.

20 Claims, 12 Drawing Sheets

(56) References Cited

U.S. PATENT DOCUMENTS

| | | | | |
|---|---|---|---|---|
| 11,164,494 | B1 * | 11/2021 | Hashimoto | G09G 3/3233 |
| 2003/0117353 | A1 * | 6/2003 | Moon | G09G 3/3655<br>345/87 |
| 2004/0233183 | A1 * | 11/2004 | Saeki | G09G 3/3688<br>345/204 |
| 2007/0069994 | A1 * | 3/2007 | Takahashi | G09G 3/3283<br>345/76 |
| 2010/0097360 | A1 * | 4/2010 | Cho | G09G 3/325<br>345/205 |
| 2012/0019569 | A1 * | 1/2012 | Byun | G09G 3/3233<br>345/77 |
| 2016/0140898 | A1 * | 5/2016 | Hyun | G09G 3/3233<br>345/694 |

* cited by examiner

SPXL: SPXL1, SPXL2, SPXL3
SPXA: SPXA1, SPXA2, SPXA3

SPXL: SPXL1, SPXL2, SPXL3
SPXA: SPXA1, SPXA2, SPXA3

FIG. 9

<LUT>

| ER'(%) | VSS'(V) |
|---|---|
| 0 | 0 |
| 1 | −0.01 |
| 2 | −0.02 |
| 3 | −0.03 |
| 4 | −0.04 |
| 5 | −0.05 |
| 6 | −0.06 |
| 7 | −0.07 |
| ⋮ | ⋮ |

PIXEL AND DISPLAY DEVICE INCLUDING THE SAME

CROSS-REFERENCE TO RELATED APPLICATION(S)

This application claims priority to and benefits of Korean Patent Application No. 10-2021-0125172 under 35 U.S.C. § 119, filed in the Korean Intellectual Property Office (KIPO) on Sep. 17, 2021, the entire contents of which are incorporated herein by reference.

BACKGROUND

1. Technical Field

The disclosure relates to a pixel and a display device including the same, which is capable of preventing a defect of a light emitting element to emit light with a target luminance.

2. Description of the Related Art

The importance of display devices as communication media has been emphasized because of increasing developments of information technology. Accordingly, research and development on a display device have been increasing and becoming more popular.

The importance of display devices as communication media, has been emphasized because of the increasing developments of information technology. Also, users of display devices such as a liquid crystal display (LCD) and an organic light emitting diode (OLED) display have been increasing and becoming more popular.

SUMMARY

Embodiments provide a pixel capable of preventing a defect of a light emitting element.

Embodiments also provide a display device including the pixel, which is capable of preventing a defect of a light emitting element to emit light with a target luminance.

However, embodiments of the disclosure are not limited to those set forth herein. The above and other embodiments will become more apparent to one of ordinary skill in the art to which the disclosure pertains by referencing the detailed description of the disclosure given below.

In order to achieve an object of the disclosure, according to embodiments of the disclosure, a pixel includes a light emitting element, a first transistor disposed between a first power and a second node and including a gate electrode electrically connected to a first node, a second transistor disposed between a data line and a first electrode of the first transistor and including a gate electrode electrically connected to a first scan line, a third transistor disposed between the first node and a second electrode of the first transistor and including a gate electrode electrically connected to the first scan line, a fourth transistor disposed between the first node and an initialization power and including a gate electrode electrically connected to a second scan line, a seventh transistor disposed between the second node and an anode initialization power and including a gate electrode electrically connected to a third scan line, an eighth transistor disposed between the second node and an anode of the light emitting element and including a gate electrode electrically connected to the third scan line, a resistor electrically connected in parallel with the eighth transistor between the second node and the anode of the light emitting element, and an amplifier having a non-inverting terminal and an inverting terminal electrically connected to ends of the resistor, respectively.

The pixel may further include an inverter electrically connected between the gate electrode of the eighth transistor and the third scan line. The seventh transistor and the eighth transistor may be P-type transistors.

The seventh transistor may be a P-type transistor, and the eighth transistor may be an N-type transistor.

The light emitting element may have a size in a range of a nano scale to a micro scale.

The pixel may further include a load disposed between the second node and the anode of the light emitting element, and electrically connected in series with the resistor. A resistance value of the load may be greater than a resistance value of the resistor.

The pixel may further include a fifth transistor disposed between the first power and the first electrode of the first transistor and including a gate electrode electrically connected to an emission control line, and a sixth transistor disposed between the second electrode of the first transistor and the second node and including a gate electrode electrically connected to the emission control line.

During a sensing period, a first scan signal of a logic high level may be provided through the first scan line, a second scan signal of a logic high level may be provided through the second scan line, and a third scan signal of a logic low level may be provided through the third scan line.

The amplifier may be a differential amplifier that outputs a potential difference between the ends of the resistor as an output signal through an output terminal.

According to an embodiment, a display device includes a display panel including a plurality of pixels, a scan driver that provides a first scan signal, a second scan signal, and a third scan signal to the pixels, a data driver that provides a data signal to the pixels, a power supply that provides a first power and a second power to the pixels, and a timing controller that controls the scan driver and the data driver.

Each of the pixels may include a light emitting element, a first transistor disposed between the first power and a second node and including a gate electrode electrically connected to a first node, a second transistor disposed between a data line and a first electrode of the first transistor and including a gate electrode electrically connected to a first scan line, a third transistor disposed between the first node and a second electrode of the first transistor and including a gate electrode electrically connected to the first scan line, a fourth transistor disposed between the first node and an initialization power and including a gate electrode electrically connected to a second scan line, a seventh transistor disposed between the second node and an anode initialization power and including a gate electrode electrically connected to a third scan line, an eighth transistor disposed between the second node and an anode of the light emitting element and including a gate electrode electrically connected to the third scan line, a resistor electrically connected in parallel with the eighth transistor between the second node and the anode of the light emitting element, and an amplifier having a non-inverting terminal and an inverting terminal electrically connected to ends of the resistor, respectively.

The seventh transistor and the eighth transistor may alternately operate.

The seventh transistor and the eighth transistor may be transistors of a same type, and the display device may further include an inverter electrically connected between the gate electrode of the eighth transistor and the third scan line.

The seventh transistor and the eighth transistor may be transistors of different types.

The display may further include a load disposed between the second node and the anode of the light emitting element, and electrically connected in series with the resistor, and a resistance value of the load may be greater than a resistance value of the resistor.

The display device may further include a fifth transistor disposed between the first power and the first electrode of the first transistor and including a gate electrode electrically connected to an emission control line, and a sixth transistor disposed between the second electrode of the first transistor and the second node and including a gate electrode electrically connected to the emission control line.

During a sensing period, the first scan signal of a logic high level may be provided through the first scan line, the second scan signal of a logic high level may be provided through the second scan line, and the third scan signal of a logic low level may be provided through the third scan line.

The amplifier may be a differential amplifier that outputs a potential difference between the ends of the resistor as an output signal through an output terminal.

The display device may further include a compensator that receives the output signal of the amplifier from each of the pixels, and calculates a sum of a sensing current amount flowing through the ends of the resistor based on the output signal.

The compensator may calculate a defect rate of the pixels according to Equation 1 below.

$$ER'[\%] = \left(1 - \frac{Is'}{ILD * N'}\right) * 100 \quad \text{[Equation 1]}$$

ER' is a defect rate of a display panel, ILD is an amount of current flowing through each light emitting element, N is the number of light emitting elements disposed on the display panel, and IS' is a sum of a sensing current amount of sub-pixels included in the display panel.

The compensator may include a lookup table matching a compensation value of the second power corresponding to the defect rate of the display panel, and the compensation value of the second power may have a less value as the defect rate of the display panel increases.

The power supply may receive the compensation value of the second power from the compensator, and provide a value which is obtained by adding the compensation value of the second power to the second power, to the pixels.

The pixel and the display device including the same according to an embodiment of the disclosure may sense the current flowing through the light emitting element to calculate the defect rate of the display panel. Thus, the driving power may be compensated in response to the defect rate, and the pixel and the display device including the same may emit light with a target luminance.

However, an effect of the disclosure is not limited to the above-described effect, and may be variously expanded without departing from the spirit and scope of the disclosure.

BRIEF DESCRIPTION OF THE DRAWINGS

An additional appreciation according to the embodiments of the disclosure will become more apparent by describing in detail the embodiments thereof with reference to the accompanying drawings, in which:

FIG. 9 is a schematic lookup table including a compensation value of second power corresponding to a defect rate of a display panel according to an embodiment.

DETAILED DESCRIPTION OF THE EMBODIMENTS

Figure 1:
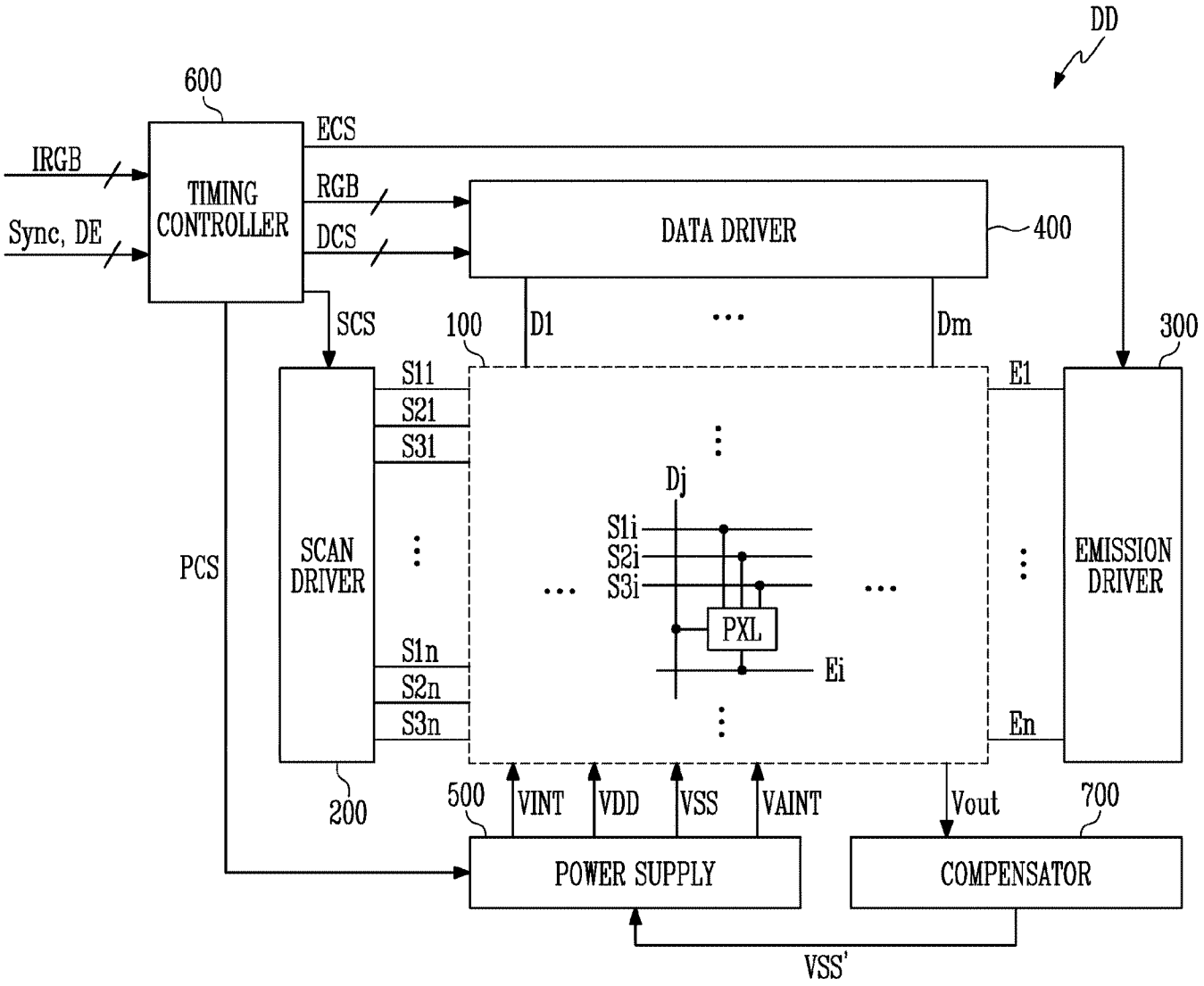
FIG. 1 is a schematic block diagram illustrating a display device according to embodiments of the disclosure.

Hereinafter, various embodiments of the disclosure will be described in detail with reference to the accompanying drawings so that those skilled in the art may readily carry out the disclosure. The disclosure may be implemented in various different forms and is not limited to the embodiments described herein.

In order to clearly describe the disclosure, parts that are not related to the description may be omitted, and the same or similar components are denoted by the same reference numerals throughout the specification. Therefore, the above-described reference numerals may be used in other drawings.

In addition, sizes and thicknesses of each component shown in the drawings are arbitrarily shown for convenience of description, and thus the disclosure is not necessarily limited to those shown in the drawings. In the drawings, thicknesses may be exaggerated to clearly express various layers and areas.

In addition, an expression "is the same" in the description may mean "is substantially the same". That is, the expression "is the same" may be the same enough for those of ordinary skill to understand that it is the same. Other expressions may also be expressions in which "substantially" is omitted.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements.

The terms "and" and "or" may be used in the conjunctive or disjunctive sense and may be understood to be equivalent to "and/or."

The terms "about" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

It will be understood that the terms "contact," "connected to," and "coupled to" may include a physical and/or electrical contact, connection, or coupling.

The phrase "at least one of" is intended to include the meaning of "at least one selected from the group of" for the purpose of its meaning and interpretation. For example, "at least one of A and B" may be understood to mean "A, B, or A and B."

Unless otherwise defined or implied herein, all terms (including technical and scientific terms) used herein have the same meaning as commonly understood by those skilled in the art to which this disclosure pertains. It will be further understood that terms, such as those defined in commonly used dictionaries, should be interpreted as having a meaning that is consistent with their meaning in the context of the relevant art and the disclosure, and should not be interpreted in an ideal or excessively formal sense unless clearly so defined herein.

FIG. 1 is a schematic block diagram illustrating a display device according to embodiments of the disclosure.

Referring to FIG. 1, the display device DD may include a display panel 100, a scan driver 200, an emission driver 300, a data driver 400, a power supply 500, a timing controller 600, and a compensator 700.

The display panel 100 may include scan lines S11 to S1*n*, S21 to S2*n*, and S31 to S3*n*, emission control lines E1 to En, and data lines D1 to Dm, and may include pixels PXL electrically connected to the scan lines S11 to S1*n*, S21 to S2*n*, and S31 to S3*n*, the emission control lines E1 to En, and the data lines D1 to Dm (where m and n are integers greater than 1).

Each of the pixels PXL may include a driving transistor and switching transistors. The pixels PXL may receive voltages of first power VDD, second power VSS, initialization power VINT, and anode initialization power VAINT from the power supply 500. Each of the pixels PXL may receive a data signal (or data voltage) through the data lines D1 to Dm. Signal lines electrically connected to the pixel PXL may be variously set in response to a circuit structure of the pixel PXL.

The timing controller 600 may receive input image data IRGB and control signals Sync and DE from a host system such as an application processor (AP) through an interface.

The timing controller 600 may generate a first control signal SCS, a second control signal ECS, a third control signal DCS, and a fourth control signal PCS based on the input image data IRGB, a synchronization signal Sync (e.g., a vertical synchronization signal, a horizontal synchronization signal, and the like), a data enable signal DE, a clock signal, or the like. The first control signal SCS may be supplied to the scan driver 200. The second control signal ECS may be supplied to the emission driver 300. The third control signal DCS may be supplied to the data driver 400. The fourth control signal PCS may be supplied to the power supply 500. The timing controller 600 may rearrange the input image data IRGB and supply the rearranged input image data IRGB (e.g., image data RGB) to the data driver 400.

The scan driver 200 may receive the first control signal SCS from the timing controller 600, and supply a first scan signal, a second scan signal, and a third scan signal to first scan lines S11 to S1*n*, second scan lines S21 to S2*n*, and third scan lines S31 to S3*n*, respectively, based on the first control signal SCS.

The first to third scan signals may be set to a gate-on voltage corresponding to a type of a transistor to which corresponding scan signals are supplied. The transistor receiving the scan signal may be set in a turn-on state in case that the scan signal is supplied. For example, the gate-on voltage of the scan signal supplied to a P-channel metal oxide semiconductor (PMOS) transistor may be a logic low level, and the gate-on voltage of the scan signal supplied to an N-channel metal oxide semiconductor (NMOS) transistor may be a logic high level. Hereinafter, a meaning of "the scan signal is supplied" may be understood to mean that the scan signal is supplied at a logic level that turns on a transistor controlled by the scan signal.

The emission driver 300 may supply an emission control signal to the emission control lines E1 to En based on the second control signal ECS. For example, the emission control signal may be sequentially supplied to the emission control lines E1 to En.

The emission control signal may be set to a gate-off voltage. The transistor receiving the emission control signal may be turned off in case that the emission control signal is supplied thereto. The transistor may be set in a turn-on state in other cases without the emission control signal. Hereinafter, a meaning of "the emission control signal is supplied" may be understood to mean that the emission control signal is supplied at a logic level that turns off a transistor controlled by the emission control signal.

In FIG. 1, the scan driver 200 and the emission driver 300 may be separate configurations for convenience of description, but the disclosure is not limited thereto. According to a design, the scan driver 200 may include multiple scan drivers that respectively supply at least one of the first to third scan signals. At least a portion of the scan driver 200 and the emission driver 300 may be integrated into a driving circuit, module, or the like.

The data driver 400 may receive the third control signal DCS and the image data RGB from the timing controller 600. The data driver 400 may convert the image data RGB of a digital format into an analog data signal (or data voltage).

The data driver 400 may supply the data signal (or data voltage) to the data lines D1 to Dm in response to the third control signal DCS. The data signal (e.g., data voltage) supplied to the data lines D1 to Dm may be supplied to be synchronized with the first scan signal supplied to the first scan lines S11 to S1*n*.

The power supply 500 may supply a voltage of the first power VDD and a voltage of the second power VSS for driving the pixel PXL to the display panel 100. A voltage level of the second power VSS may be less than a voltage level of the first power VDD. For example, the voltage of the first power VDD may be a positive voltage, and the voltage of the second power VSS may be a negative voltage.

The power supply 500 may supply a voltage of the initialization power VINT to the display panel 100. The initialization power VINT may initialize the driving transistor included in the pixel PXL.

The power supply 500 may supply a voltage of the anode initialization power VAINT to the display panel 100. The anode initialization power VAINT may initialize a light emitting element included in the pixel PXL.

The compensator 700 may receive an output signal Vout from the display panel 100 (or pixels PXL), calculate a compensation value VSS' of the second power based on the received output signal Vout, and provide the compensation value VSS' to the power supply 500. Descriptions of the compensator 700 are provided below with reference to FIGS. 7 to 10.

Figure 2:
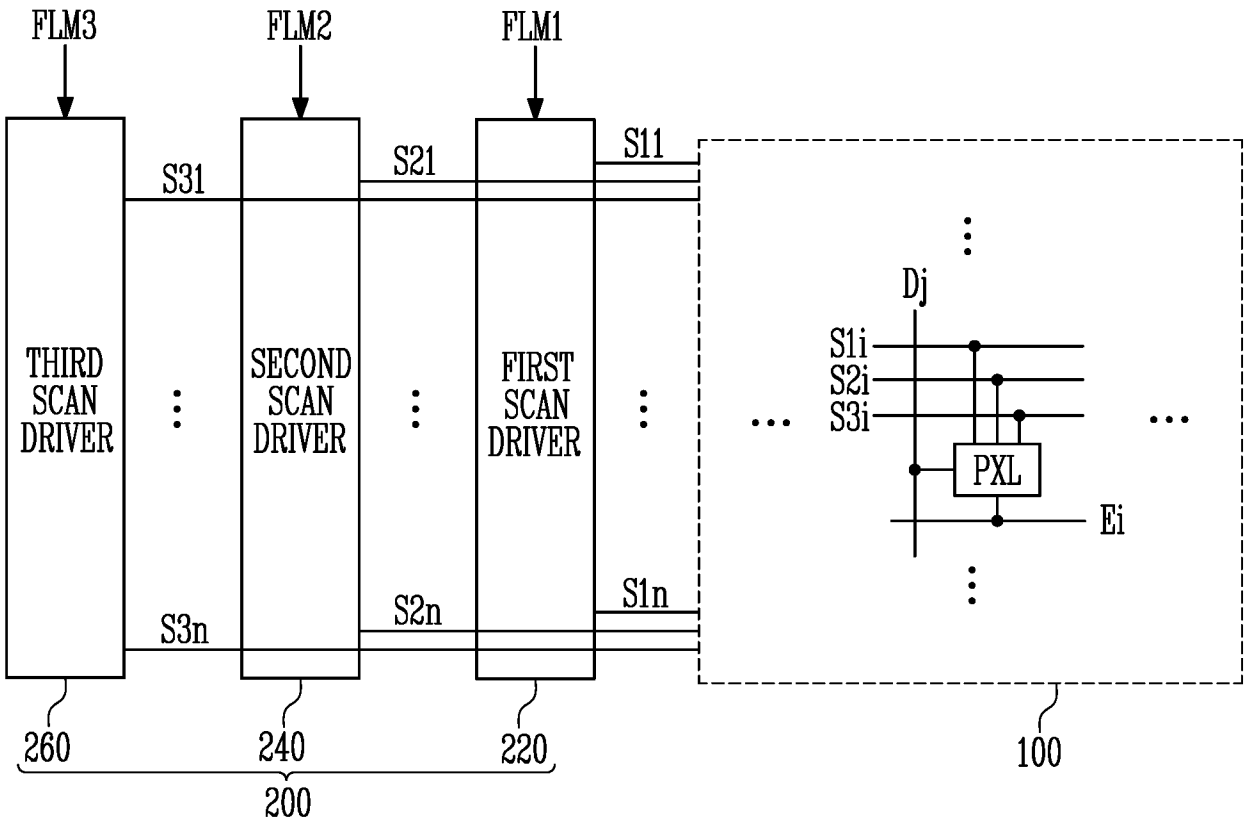
FIG. 2 is a schematic diagram illustrating an example of a scan driver included in the display device of FIG. 1.

FIG. 2 is a schematic diagram illustrating an example of the scan driver included in the display device of FIG. 1.

Referring to FIGS. 1 and 2, the scan driver 200 may include a first scan driver 220, a second scan driver 240, and a third scan driver 260.

The first control signal SCS may include first to third scan start signals FLM1 to FLM3. The first to third scan start signals FLM1 to FLM3 may be supplied to the first to third scan drivers 220, 240, and 260, respectively.

A width, a supply timing, and the like of the first to third scan start signals FLM1 to FLM3 may be determined according to a driving condition of the pixel PXL and a frame frequency. The first to third scan signals may be output based on the first to third scan start signals FLM1 to FLM3, respectively. For example, a signal width of at least one of the first to third scan signals may be different from a signal width of another one of the first to third scan signals.

The first scan driver 220 may sequentially supply the first scan signal to the first scan lines S11 to S1*n* in response to the first scan start signal FLM1. The second scan driver 240 may sequentially supply the second scan signal to the second scan lines S21 to S2*n* in response to the second scan start signal FLM2. The third scan driver 260 may sequentially supply the third scan signal to the third scan lines S31 to S3*n* in response to the third scan start signal FLM3.

Figure 3:
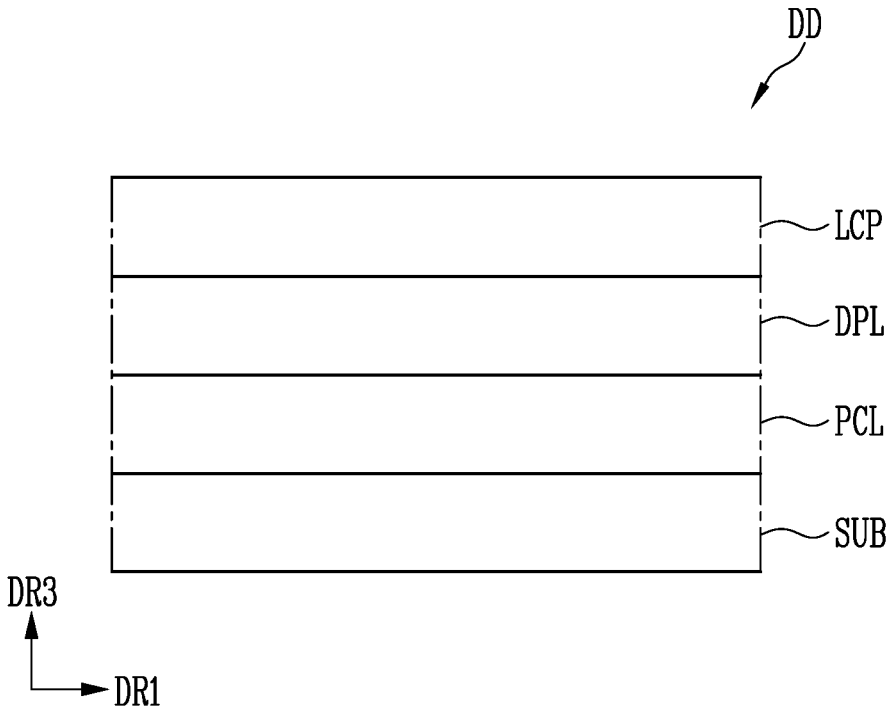
FIG. 3 is a schematic cross-sectional view illustrating a display panel according to an embodiment.

FIG. 3 is a schematic cross-sectional view illustrating a display panel according to an embodiment.

The display panel 100 (e.g., refer to FIG. 1) (or display device DD) may include a substrate SUB, a pixel circuit part PCL, a display element part DPL, and a light control part LCP. According to an example, the substrate SUB, the pixel circuit part PCL, the display element part DPL, and the light control part LCP may be sequentially stacked in a display direction (e.g., third direction DR3) of the display panel 100. The display direction (e.g., third direction DR3) may mean a thickness direction of the substrate SUB.

The substrate SUB may configure (or form) a base surface of the display panel 100. An individual configuration (or elements) of the display panel 100 may be disposed on the substrate SUB.

The pixel circuit part PCL may be disposed on the substrate SUB. The pixel circuit part PCL may include a pixel circuit PXC (e.g., refer to FIG. 4) configured to drive the pixel PXL.

The display element part DPL may be disposed on the pixel circuit part PCL. The display element part DPL may emit light based on an electrical signal provided from the pixel circuit part PCL. The display element part DPL may include a light emitting element LD (e.g., refer to FIG. 4) capable of emitting the light. The light emitted from the display element part DPL may pass through the light control part LCP and may be provided to the outside.

Figure 5:
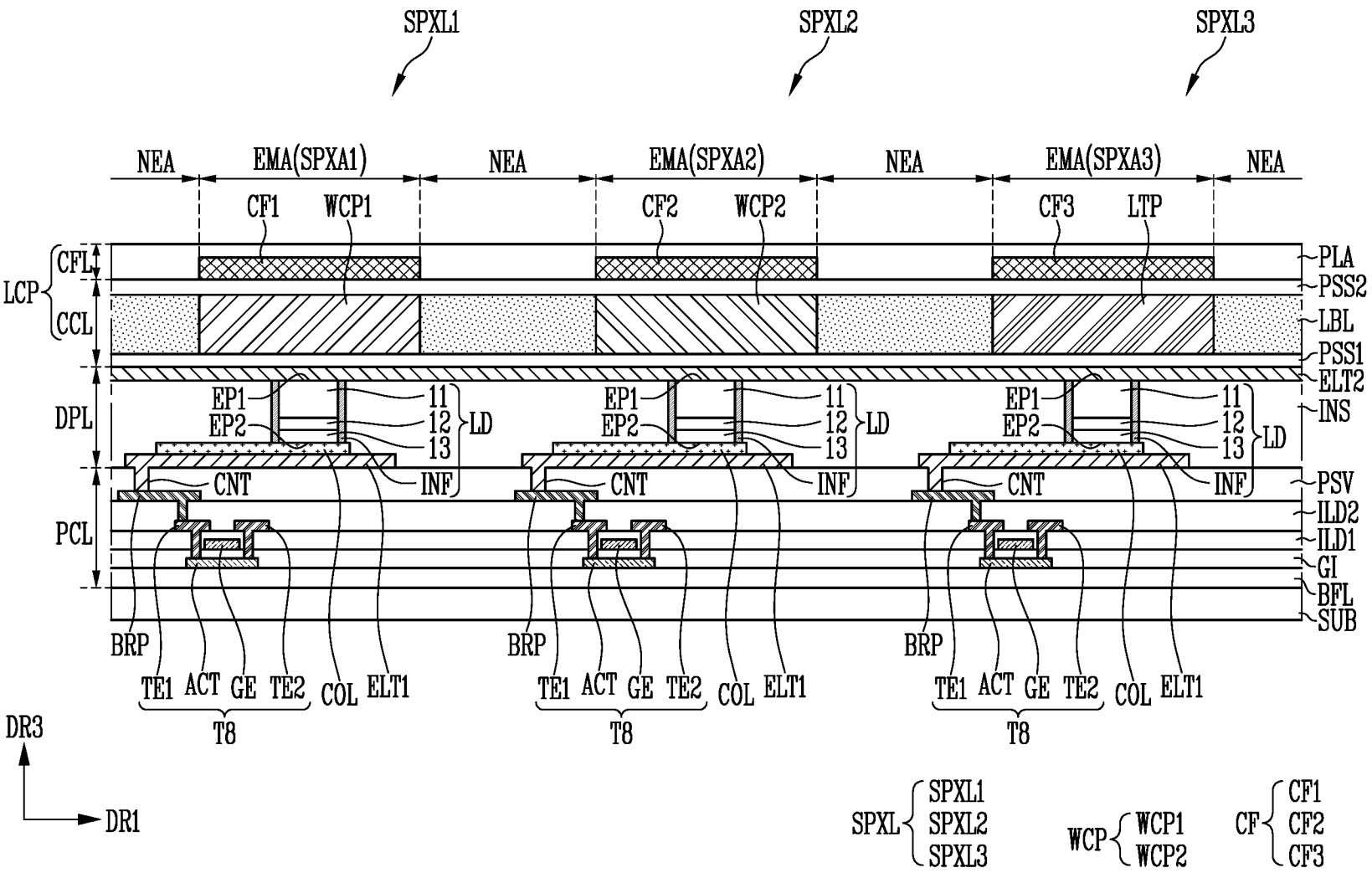
FIG. 5 is a cross-sectional view schematically illustrating a pixel according to an embodiment.

The light control part LCP may be disposed on the display element part DPL. The light control part LCP may be disposed on the light emitting elements LD. The light control part LCP may change a wavelength of the light provided from the display element part DPL (or light emitting elements LD). According to an example, as shown in FIG. 5, the light control part LCP may include a color conversion part CCL configured to change a wavelength of the light and a color filter part CFL configured to transmit light having a specific wavelength.

Figure 4:
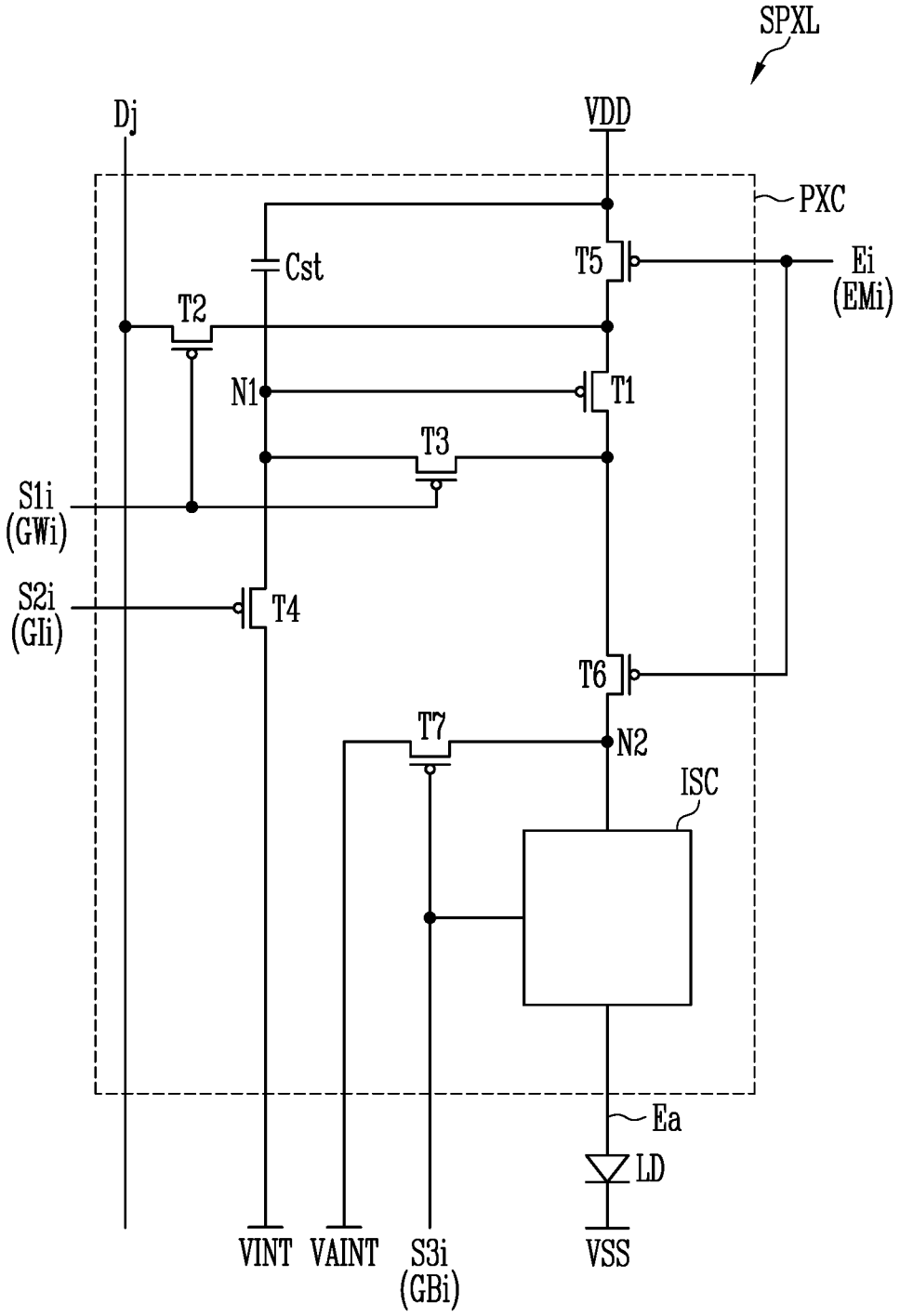
FIG. 4 is a schematic diagram illustrating a pixel circuit included in a pixel according to an embodiment.
Figure 6A:
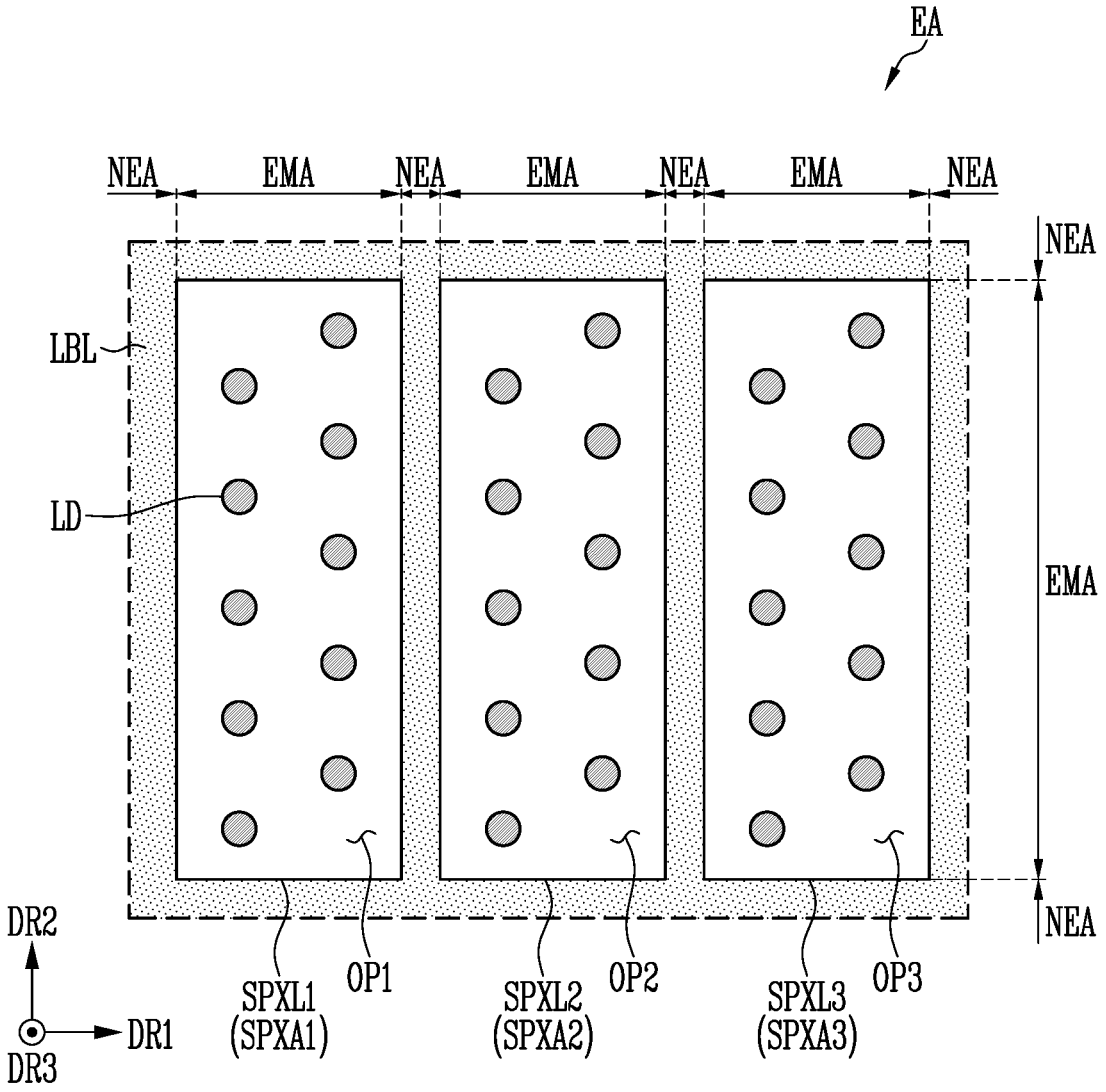
FIG. 6A is a schematic diagram illustrating light emitting elements disposed in the pixel of FIG. 5.
Figure 6B:
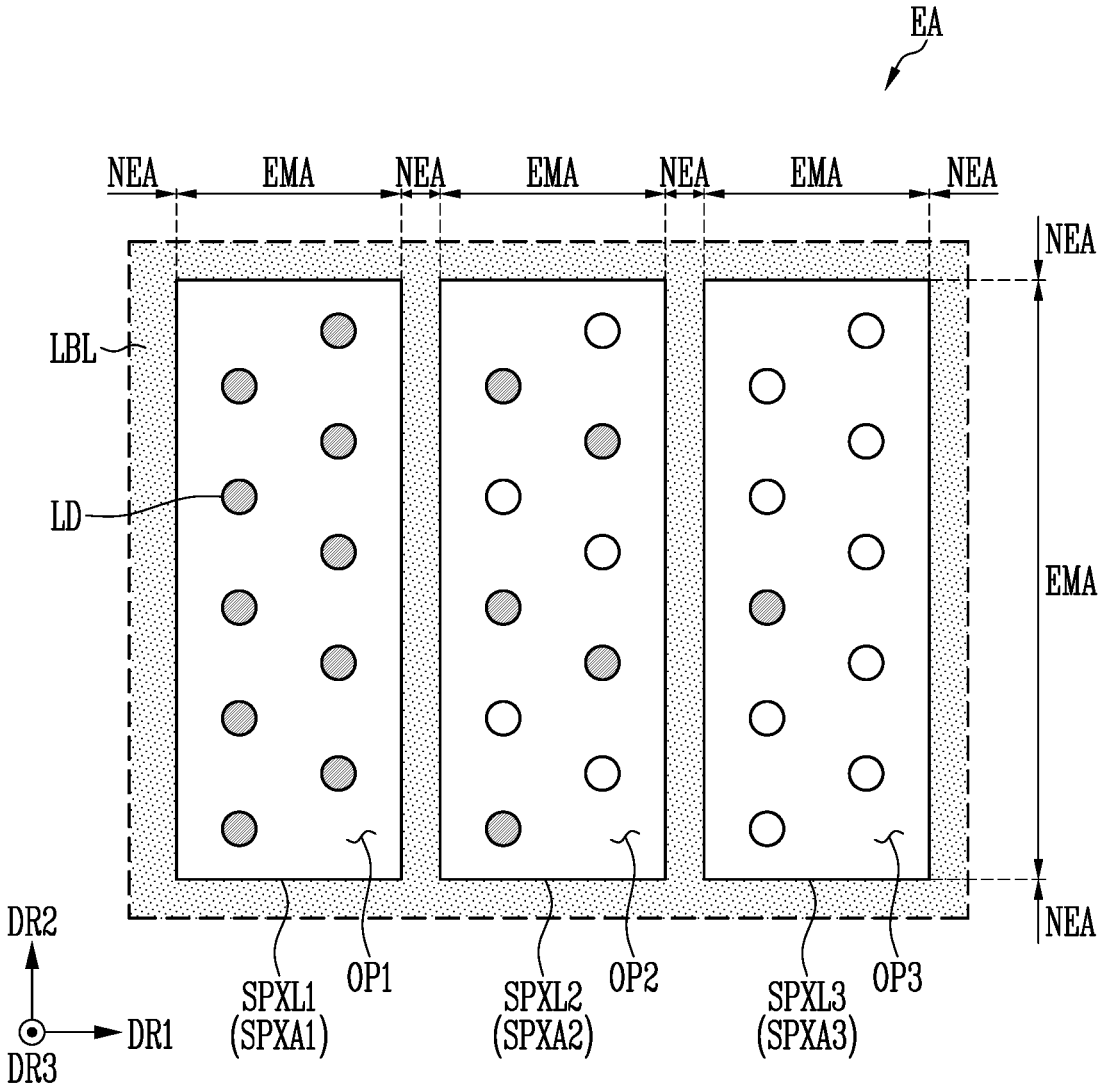
FIG. 6B is a schematic diagram illustrating a defect rate of the light emitting element of FIG. 5.

FIG. 4 is a schematic diagram illustrating a pixel circuit included in a sub-pixel according to an embodiment. As shown in FIGS. 6A and 6B, the pixel PXL may include first to third sub-pixels SPXL1, SPXL2, and SPXL3.

FIG. 4 shows an electrical connection relationship between components included in a sub-pixel SPXL of the display device DD (e.g., refer to FIG. 1), as one of embodiments. However, a type of the components included in the sub-pixel SPXL to which an embodiment of the disclosure may be applied is not limited thereto.

Referring to FIG. 4, the sub-pixel SPXL may include the light emitting element LD and the pixel circuit PXC. The pixel circuit PXC may include a current sensing circuit ISC. In FIG. 4, the current sensing circuit ISC may be included in the pixel circuit PXC, but the disclosure is not limited thereto. For example, the current sensing circuit ISC may be formed separately from the pixel circuit PXC.

For convenience of description, FIG. 4 shows a sub-pixel SPXL provided in a region where a j-th data line Dj and i-th scan lines S1*i*, S2*i*, and S3*i* intersect each other (here, i is a natural number equal to or less than n, and j is a natural number equal to or less than m).

The sub-pixel SPXL may be electrically connected to the j-th data line Dj, a 1i-th scan line S1*i*, a 2i-th scan line S2*i*, a 3i-th scan line S3*i*, and an i-th emission control line Ei. According to an embodiment, the pixel circuit PXC may be electrically connected to the first and second driving powers VDD and VSS, the initialization power VINT, and the anode initialization power VAINT.

Referring to FIG. 4, the pixel circuit PXC according to an embodiment of the disclosure may include a first transistor T1, a second transistor T2, a third transistor T3, a fourth transistor T4, a fifth transistor T5, a sixth transistor T6, a seventh transistor T7, a storage capacitor Cst, and the current sensing circuit ISC.

A first electrode of the first transistor T1 (or driving transistor) may be electrically connected to the first power VDD via the fifth transistor T5, and a second electrode may be electrically connected to an anode Ea of the light emitting element LD (or second node N2) via the sixth transistor T6. For example, the second electrode of the first transistor T1 may be electrically connected to the second node N2 through the sixth transistor T6, and electrically connected to the anode Ea of the light emitting element LD through the sixth transistor T6 and the current sensing circuit ISC. A gate electrode of the first transistor T1 may be electrically connected to a first node N1. The first transistor T1 may control a driving current ID (e.g., refer to FIG. 7) flowing between the first power VDD and the second power VSS via the light emitting elements LD, in response to a voltage of the first node N1.

The second transistor T2 (or switching transistor) may be electrically connected between the j-th data line Dj electrically connected to the pixel PXL and the first electrode of the first transistor T1. A gate electrode of the second transistor T2 may be electrically connected to the 1i-th scan line S1*i* electrically connected to the pixel PXL. The second transistor T2 may be turned on in case that a scan signal GWi of a gate-on voltage (e.g., a low voltage) is supplied from the 1i-th scan line S1*i*, to electrically connect the j-th data line Dj to the first electrode of the first transistor T1. Therefore, in case that the second transistor T2 is turned on, the data signal supplied from the j-th data line Dj may be transferred to the first transistor T1.

The third transistor T3 may be electrically connected between the second electrode of the first transistor T1 and the first node N1. A gate electrode of the third transistor T3 may be electrically connected to the 1i-th scan line S1*i*. The third transistor T3 may be turned on in case that the scan signal GWi of the gate-on voltage is supplied from the 1i-th scan line S1*i*, to electrically connect the second electrode of the first transistor T1 and the first node N1.

The fourth transistor T4 may be electrically connected between the first node N1 and the initialization power VINT. A gate electrode of the fourth transistor T4 may be electrically connected to a previous scan line (e.g., 2i-th scan line S2*i*). The fourth transistor T4 may be turned on in case that a scan signal GIi of a gate-on voltage is supplied to the 2i-th scan line S2*i*, to transfer the voltage of the initialization power VINT to the first node N1. The initialization power VINT may have a voltage equal to or less than the lowest voltage of the data signal.

The fifth transistor T5 may be electrically connected between the first power VDD and the first transistor T1. A gate electrode of the fifth transistor T5 may be electrically connected to the i-th emission control line Ei. The fifth transistor T5 may be turned off in case that an emission control signal EMi of a gate-off voltage is supplied to the i-th emission control line Ei, or may be turned on in other cases (e.g., in case that gate-off voltage is not supplied to i-th emission control line Ei).

The sixth transistor T6 may be electrically connected between the first transistor T1 and the second node N2. A gate electrode of the sixth transistor T6 may be electrically connected to the i-th emission control line Ei. The sixth transistor T6 may be turned off in case that the emission control signal EMi of the gate-off voltage is supplied to the i-th emission control line Ei, or may be turned on in other cases (e.g., in case that gate-off voltage is not supplied to i-th emission control line Ei).

The seventh transistor T7 may be electrically connected between the second node N2 and the anode initialization power VAINT. A gate electrode of the seventh transistor T7 may be electrically connected to the 3i-th scan line S3*i*. The seventh transistor T7 may be turned on in case that a scan signal GBi of a gate-on voltage is supplied to the 3i scan line S3*i*, to supply the voltage of the anode initialization power VAINT to the second node N2.

The storage capacitor Cst may be electrically connected or formed between the first power VDD and the first node N1. The storage capacitor Cst may store a voltage corresponding to the data signal supplied to the first node N1 and a threshold voltage of the first transistor T1 in each frame period.

In FIG. 4, all of the transistors (e.g., first to seventh transistors T1 to T7) included in the pixel circuit PXC may be P-type transistors, but the disclosure is not limited thereto. For example, at least one of the first to seventh transistors T1 to T7 may be changed to an N-type transistor.

The current sensing circuit ISC may be disposed between the second node N2 and the light emitting element LD. The current sensing circuit ISC may sense or measure a current flowing between the second node N2 and the light emitting element LD to measure a current flowing through the light emitting element LD. The current sensing circuit ISC according to an embodiment may include a resistor R (e.g., refer to FIG. 7), a load LOAD (e.g., refer to FIG. 7), an amplifier AMP (e.g., refer to FIG. 7), and a transistor T8 (e.g., refer to FIG. 7). However, the current sensing circuit ISC is not limited thereto, and may include various circuits capable of sensing the current flowing between the second node N2 and the light emitting element LD. Descriptions of the current sensing circuit ISC are provided below with reference to FIGS. 7 to 10.

Hereinafter, a structure of the sub-pixels SPXL1, SPXL2, and SPXL3 configuring the pixel PXL is described in more detail with reference to FIG. 5. Detailed descriptions of the same constituent elements are briefly described or omitted.

FIG. 5 is a cross-sectional view schematically illustrating a pixel according to an embodiment.

FIG. 5 shows the first sub-pixel SPXL1, the second sub-pixel SPXL2, and the third sub-pixel SPXL3.

Figure 7:
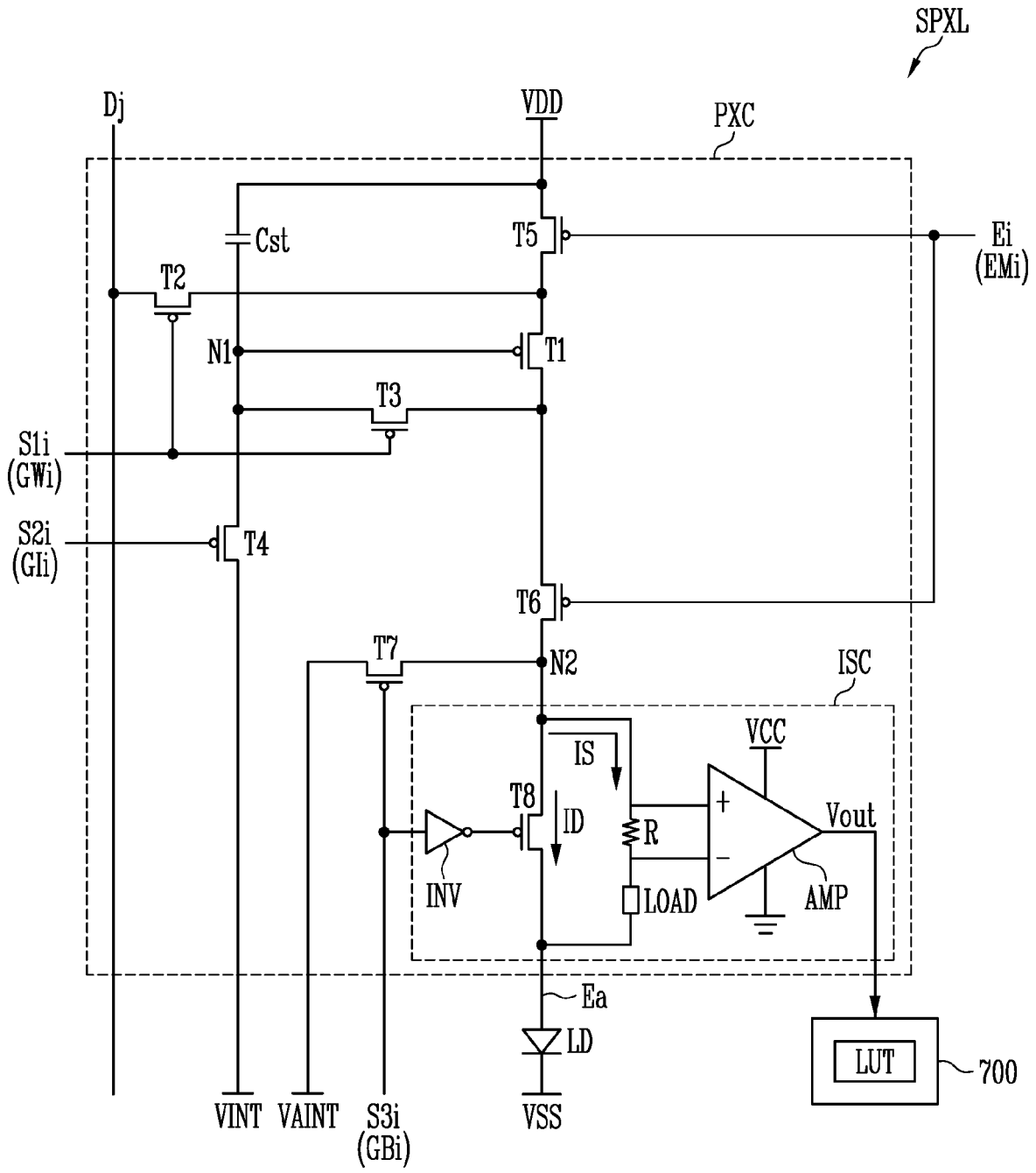
FIG. 7 is a schematic diagram illustrating a current sensing circuit according to an embodiment.
Figure 10:
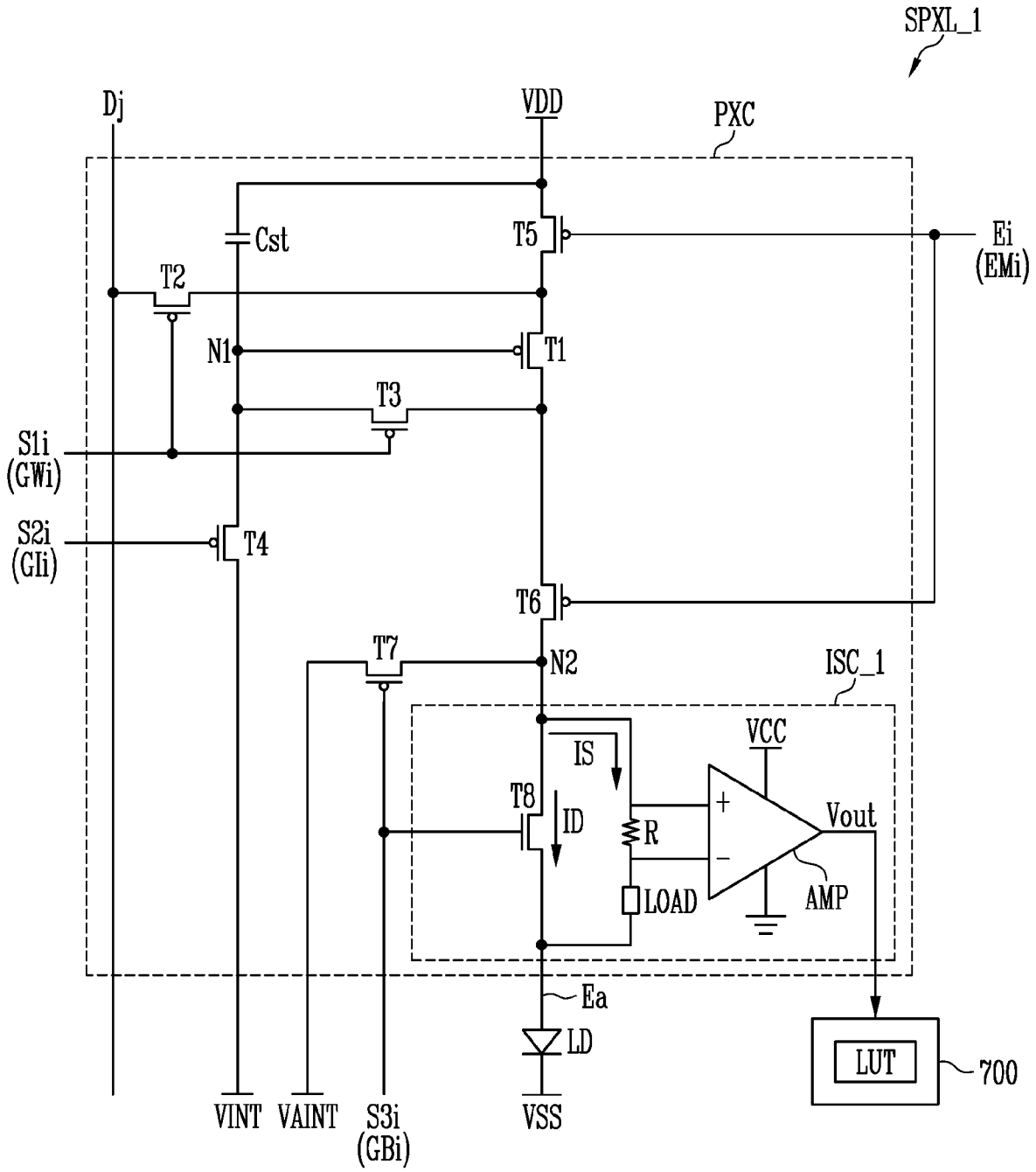
FIG. 10 is a schematic diagram illustrating a current sensing circuit according to another embodiment.

In FIG. 5, each of the first to third sub-pixels SPXL1, SPXL2, and SPXL3 may include the pixel circuit PXC described with reference to FIG. 4. For example, an embodiment in which an eighth transistor T8 shown in FIGS. 7 and 10 is provided in each of the first sub-pixel SPXL1, the second sub-pixel SPXL2, and the third sub-pixel SPXL3 is shown.

The pixel circuit part PCL may be disposed on the substrate SUB. The pixel circuit part PCL may include a buffer layer BFL, the eighth transistor T8, a gate insulating layer GI, a first interlayer insulating layer ILD1, a second interlayer insulating layer ILD2, a bridge pattern BRP, a contact portion CNT, and a protective layer PSV.

According to an example, individual configurations of the pixel circuit part PCL may be defined in each of the first to third sub-pixels SPXL1, SPXL2, and SPXL3.

The buffer layer BFL may be disposed on the substrate SUB. The buffer layer BFL may prevent an impurity from diffusing from the outside. The buffer layer BFL may include at least one metal oxide such as silicon nitride ($SiN_x$), silicon oxide ($SiO_x$), silicon oxynitride ($SiO_xN_y$), and aluminum oxide ($AlO_x$).

According to an embodiment, the eighth transistor T8 may be a thin film transistor. The eighth transistor T8 may be electrically connected to the light emitting element LD. For example, the eighth transistor T8 of the first sub-pixel SPXL1 may be electrically connected to a light emitting element LD disposed in a first sub-pixel area SPXA1. The eighth transistor T8 of the second sub-pixel SPXL2 may be electrically connected to a light emitting element LD disposed in a second sub-pixel area SPXA2. The eighth transistor T8 of the third sub-pixel SPXL3 may be electrically connected to a light emitting element LD disposed in a third sub-pixel area SPXA3.

According to an embodiment, the eighth transistor T8 may include an active layer ACT, a first electrode TE1, a second electrode TE2, and a gate electrode GE.

The active layer ACT of the eighth transistor T8 may refer to a semiconductor layer. The active layer ACT may be disposed on the buffer layer BFL. The active layer ACT may include at least one of polysilicon, amorphous silicon, and an oxide semiconductor.

According to an embodiment, the active layer ACT of the eighth transistor T8 may include a first contact region in contact with the first electrode TE1 of the eighth transistor T8 and a second contact region in contact with the second electrode TE2 of the eighth transistor T8. Each of the first contact region and the second contact region may be a semiconductor pattern doped with an impurity. A region between the first contact region and the second contact region may be a channel region. The channel region may be an intrinsic semiconductor pattern that is not doped with an impurity.

The gate electrode GE of the eighth transistor T8 may be disposed on the gate insulating layer GI. A position of the gate electrode GE may correspond to a position of the channel region of the active layer ACT. For example, the gate electrode GE may be disposed on the channel region of the active layer ACT with the gate insulating layer GI interposed therebetween.

The gate insulating layer GI may be disposed on the active layer ACT. The gate insulating layer GI may include an inorganic material. According to an example, the gate insulating layer GI may include at least one of silicon nitride ($SiN_x$), silicon oxide ($SiO_x$), silicon oxynitride ($SiO_xN_y$), and aluminum oxide ($AlO_x$). According to an embodiment, the gate insulating layer GI may include an organic material.

The first interlayer insulating layer ILD1 may be disposed on the gate electrode GE. Similarly to the gate insulating layer GI, the first interlayer insulating layer ILD1 may include at least one of silicon nitride ($SiN_x$), silicon oxide ($SiO_x$), silicon oxynitride ($SiO_xN_y$), and aluminum oxide ($AlO_x$).

The first electrode TE1 and the second electrode TE2 of the eighth transistor T8 may be disposed on the first interlayer insulating layer ILD1. The first electrode TE1 of the eighth transistor T8 may pass through the gate insulating layer GI and the first interlayer insulating layer ILD1 to contact the first contact region of the active layer ACT. For example, the first electrode TE1 of the eighth transistor T8 may be electrically connected to the first contact region of the active layer ACT through a contact hole passing through the gate insulating layer GI and the first interlayer insulating layer ILD1. The second electrode TE2 of the eighth transistor T8 may pass through the gate insulating layer GI and the first interlayer insulating layer ILD1 to contact the second contact region of the active layer ACT. For example, the second electrode TE2 of the eighth transistor T8 may be electrically connected to the second contact region of the active layer ACT through a contact hole passing through the gate insulating layer GI and the first interlayer insulating layer ILD1. According to an example, the first electrode TE1 of the eighth transistor T8 may be a source electrode, and the second electrode TE2 of the eighth transistor T8 may be a drain electrode, but the disclosure is not limited thereto.

The second interlayer insulating layer ILD2 may be disposed on the first electrode TE1 and the second electrode TE2 of the eighth transistor T8. Similarly to the first interlayer insulating layer ILD1 and the gate insulating layer GI, the second interlayer insulating layer ILD2 may include an inorganic material. An example of the inorganic material may include materials that may be used to form (or configure) the first interlayer insulating layer ILD1 and the gate insulating layer GI, e.g., as discussed herein. For example, the second interlayer insulating layer ILD2 may include at least one of silicon nitride ($SiN_x$), silicon oxide ($SiO_x$), silicon oxynitride ($SiO_xN_y$), and aluminum oxide ($AlO_x$). According to an embodiment, the second interlayer insulating layer ILD2 may include an organic material.

The bridge pattern BRP may be disposed on the second interlayer insulating layer ILD2. The bridge pattern BRP may be electrically connected to the first electrode TE1 of the eighth transistor T8 through a contact hole passing through the second interlayer insulating layer ILD2.

The protective layer PSV may be disposed on the second interlayer insulating layer ILD2. The protective layer PSV may cover the bridge pattern BRP. The protective layer PSV may be provided as an organic insulating layer, an inorganic insulating layer, or multiple layers including a combination thereof (e.g., inorganic insulating layer and organic insulating layer disposed thereon), but is not limited thereto. According to an embodiment, a contact portion CNT electrically connected to a region of the bridge pattern BRP may be formed in the protective layer PSV. For example, the contact portion CNT may be electrically connected to the bridge pattern BRP through a contact hole passing through the protective layer PSV.

The display element part DPL may be disposed on the pixel circuit part PCL. The display element part DPL may include a first electrode ELT1 (or anode Ea of light emitting element LD of FIG. 4), a connection electrode COL, an insulating layer INS, the light emitting element LD, and a second electrode ELT2. According to an example, individual configurations of the display element part DPL may be defined in each of the first to third sub-pixels SPXL1, SPXL2, and SPXL3.

The first electrode ELT1 may be disposed on the protective layer PSV. The first electrode ELT1 (or anode Ea of light emitting element LD of FIG. 4) may be disposed under the light emitting element LD. The first electrode ELT1 may be electrically connected to the bridge pattern BRP through the contact portion CNT.

According to an embodiment, the first electrode ELT1 (or anode Ea of light emitting element LD of FIG. 4) may be electrically connected to the light emitting element LD. According to an example, the first electrode ELT1 may provide an electrical signal provided from the eighth transistor T8 to the light emitting element LD. The first electrode ELT1 may apply an anode signal to the light emitting element LD.

According to an embodiment, the first electrode ELT1 (or anode Ea of light emitting element LD of FIG. 4) may include a conductive material. For example, the first electrode ELT1 may include at least one metal such as silver (Ag), magnesium (Mg), aluminum (Al), platinum (Pt), palladium (Pd), gold (Au), nickel (Ni), neodymium (Nd), iridium (Ir), chromium (Cr), and titanium (Ti). For example, the first electrode ELT1 may include an alloy thereof. However, the first electrode ELT1 is not limited to the above-described example.

The connection electrode COL may be disposed on the first electrode ELT1 (or anode Ea of light emitting element LD of FIG. 4). For example, a surface of the connection electrode COL may be electrically connected to (or contact) the light emitting element LD, and another surface of the connection electrode COL may be electrically connected to (or contact) the first electrode ELT1.

The connection electrode COL may include a conductive material to electrically connect the first electrode ELT1 (or anode Ea of light emitting element LD of FIG. 4) to the light emitting element LD. For example, the connection electrode COL may be electrically connected to a second semiconductor layer 13 of the light emitting element LD. According to an embodiment, the connection electrode COL may include a conductive material having a reflective property to reflect the light emitted from the light emitting element LD. Thus, light emission efficiency of the pixel PXL may be improved.

According to an embodiment, the connection electrode COL may be a bonding metal that is bonded to the light emitting element LD. The connection electrode COL may be bonded to the light emitting element LD.

The light emitting element LD may be included in each of the first to third sub-pixels SPXL1, SPXL2, and SPXL3. The light emitting element LD may be configured to emit the light. The light emitting element LD may include a first semiconductor layer 11, the second semiconductor layer 13, and an active layer 12 interposed between the first and second semiconductor layers 11 and 13. For example, in case that an extension direction of the light emitting element LD is referred to as a length direction thereof, the light emitting element LD may include the first semiconductor layer 11, the active layer 12, and the second semiconductor layer 13 sequentially stacked one another in the length direction.

According to an embodiment, the light emitting element LD may be provided in a column shape extending in a direction (e.g., length direction). The light emitting element LD may have a first end EP1 and a second end EP2. One of the first and second semiconductor layers 11 and 13 may be adjacent to the first end EP1 of the light emitting element LD. The other of the first and second semiconductor layers 11 and 13 may be adjacent to the second end EP2 of the light emitting element LD.

According to an embodiment, the light emitting element LD may be a light emitting element manufactured in the column shape through an etching method or the like. In the specification, the columnar shape encompasses a rod-like shape or a bar-like shape that is long in the length direction (e.g., having an aspect ratio greater than 1), such as a circular column or a polygonal column. A shape of a cross-section of the light emitting element LD is not limited thereto. For example, a length of the light emitting element LD may be greater than a diameter thereof or a width of the cross-section thereof.

According to an embodiment, the light emitting element LD may have a size as small as a nanometer scale to a micrometer scale. For example, each of the light emitting elements LD may have a diameter (or width) and/or a length in a range of a nanometer scale to a micrometer scale. However, the size of the light emitting element LD is not limited thereto.

The first semiconductor layer 11 may be a semiconductor layer of a first conductivity type. For example, the first semiconductor layer 11 may include an N-type semiconductor layer. For example, the first semiconductor layer 11 may include at least one semiconductor material of InAlGaN, GaN, AlGaN, InGaN, AlN, and InN, and may include an N-type semiconductor layer doped with a first conductivity type dopant such as Si, Ge, or Sn. However, a material configuring the first semiconductor layer 11 is not limited thereto.

The active layer 12 may be disposed on the first semiconductor layer 11 and may be formed in a single-quantum well or multi-quantum well structure. For example, in case that the active layer 12 is formed in the multi-quantum well structure, a barrier layer (not shown), a strain reinforcing layer, and a well layer may be periodically and repeatedly stacked in the active layer 12 as a part. For example, a combination of the barrier layer, the strain reinforcing layer, and the well layer may be periodically and repeatedly stacked to form the active layer 12. The strain reinforcing layer may have a lattice constant less than that of the barrier layer, and further enhance a strain (e.g., a compressive strain) applied to the well layer. However, a structure of the active layer 12 is not limited to the above-described embodiment.

According to an embodiment, the active layer 12 may emit light having a wavelength in a range of about 400 nm to about 900 nm. According to an example, the active layer 12 may include a material such as AlGaN or InAlGaN, but is not limited to the above-described example.

The second semiconductor layer 13 may be disposed on the active layer 12, and may include a semiconductor layer of a type different from that of the first semiconductor layer 11. For example, the second semiconductor layer 13 may include a P-type semiconductor layer. For example, the second semiconductor layer 13 may include at least one semiconductor material of InAlGaN, GaN, AlGaN, InGaN, AlN, and InN, and may include a P-type semiconductor layer doped with a second conductivity type dopant such as Mg. However, a material configuring the second semiconductor layer 13 is not limited thereto, and other various materials may configure the second semiconductor layer 13.

In case that a voltage equal to or greater than a threshold voltage is applied to both ends EP1 and EP2 of the light emitting element LD, electron-hole pairs are combined in the active layer 12. Thus, the light emitting element LD may emit the light. Light emission of the light emitting element LD may be controlled using the above-described principle (e.g., combination of electron-hole pairs), and the light emitting element LD may be used as a light source of various light emitting devices including the pixel PXL (e.g., refer to FIG. 1) of the display device DD (e.g., refer to FIG. 1).

According to an embodiment, the light emitting element LD may further include an insulating layer INF provided on a surface thereof. The insulating layer INF may be formed of a single layer or a double layer, but is not limited thereto, and may be configured of multiple layers. For example, the insulating layer INF may include a first insulating layer including a first material and a second insulating layer including a second material different from the first material.

According to an embodiment, the insulating layer INF may expose both ends EP1 and EP2 of the light emitting element LD having different polarities. For example, the insulating layer INF may expose an end of each of the first and second semiconductor layers 11 and 13 positioned at the first and second ends EP1 and EP2 of the light emitting element LD.

According to an embodiment, the insulating layer INF may include an inorganic material. For example, the insulating layer INF may be configured of a single layer or multiple layers, and include at least one insulating material of silicon oxide ($SiO_x$), silicon nitride ($SiN_x$), silicon oxynitride ($SiO_xN_y$), aluminum oxide ($AlO_x$), and titanium oxide ($TiO_x$), but is not limited thereto.

According to an embodiment, the insulating layer INF may secure electrical stability of the light emitting element LD. Although multiple light emitting elements LD are disposed close to each other, the insulating layer INF may prevent a short circuit between adjacent ones of the light emitting elements LD from occurring.

According to an embodiment, the light emitting element LD may further include an additional configuration other than the above-described configuration. For example, the light emitting element LD may additionally include one or more phosphor layers, active layers, semiconductor layers, and/or electrode layers disposed on an end side of the first semiconductor layer 11, the active layer 12 and/or the second semiconductor layer 13. For example, a contact electrode layer may be further disposed on each of the first and second ends EP1 and EP2 of the light emitting element LD.

The insulating layer INS may be disposed on the protective layer PSV. The insulating layer INS may cover at least a portion of the first electrode ELT1 (or anode Ea of light emitting element LD of FIG. 4) and/or the connection electrode COL. The insulating layer INS may be provided between the light emitting elements LD bonded to the connection electrode COL. The insulating layer INS may be disposed between the light emitting elements LD, and an outer surface of the light emitting element LD may be covered by the insulating layer INS. According to an example, the insulating layer INS may include any one of the materials that may be used to form the insulating layer INF, e.g., as discussed herein, but is not limited thereto.

The second electrode ELT2 may be disposed on the insulating layer INS. The second electrode ELT2 may be disposed on the light emitting element LD.

According to an embodiment, the second electrode ELT2 may be electrically connected to the light emitting element LD. For example, the second electrode ELT2 may be electrically connected to multiple light emitting elements LD in the first sub-pixel SPXL1, the second sub-pixel SPXL2, and the third sub-pixel SPXL3. The second electrode ELT2 may be electrically connected to the first semiconductor layer 11. According to an example, the second electrode ELT2 may apply a cathode signal to the light emitting element LD. The second electrode ELT2 may provide an electrical signal supplied from the second power VSS to the light emitting element LD.

According to an embodiment, the second electrode ELT2 may include a conductive material. For example, the second electrode ELT2 may include a transparent conductive material. The second electrode ELT2 may include at least one conductive oxide such as indium tin oxide (ITO), indium zinc oxide (IZO), zinc oxide (ZnO), indium gallium zinc oxide (IGZO), or indium tin zinc oxide (ITZO), or a conductive polymer such as poly(3,4-ethylenedioxythiophene) (PEDOT). However, the second electrode ELT2 is not limited to the above-described example.

The light control part LCP may be disposed on the display element part DPL. The light control part LCP may change the wavelength of the light provided from the display element part DPL. The light control part LCP may include the color conversion part CCL and the color filter part CFL.

According to an embodiment, the light emitting elements LD disposed in each of the first sub-pixel SPXL1, the second sub-pixel SPXL2, and the third sub-pixel SPXL3 may emit light of the same color. For example, the first sub-pixel SPXL1, the second sub-pixel SPXL2, and the third sub-pixel SPXL3 may include light emitting elements LD that emit a third color (e.g., blue light). Since the light controller LCP is disposed on the first sub-pixel SPXL1, the second sub-pixel SPXL2, and the third sub-pixel SPXL3, a full-color image may be displayed. However, the disclosure is not limited thereto, and the first sub-pixel SPXL1, the second sub-pixel SPXL2, and the third sub-pixel SPXL3 may include light emitting elements LD that emit light of different colors.

The color conversion part CCL may include a first passivation layer PSS1, a wavelength conversion pattern WCP, a light transmission pattern LTP, a light blocking layer LBL, and a second passivation layer PSS2. The wavelength conversion pattern WCP may include a first wavelength conversion pattern WCP1 and a second wavelength conversion pattern WCP2.

The first passivation layer PSS1 may be disposed between the display element part DPL and the light blocking layer LBL or the wavelength conversion pattern WCP. The first passivation layer PSS1 may seal (or cover) the wavelength conversion pattern WCP. The first passivation layer PSS1 may include any one of the materials that may be used to form the insulating layer INF, e.g., as discussed herein, but is not limited thereto.

Although not shown in the drawings, an adhesive layer may be interposed between the first passivation layer PSS1 and the second electrode ELT2. The adhesive layer may couple the first passivation layer PSS1 and the second electrode ELT2 to each other. The adhesive layer may include an adhesive material, and is not limited to a specific example.

The first wavelength conversion pattern WCP1 may overlap an emission area EMA (e.g., first sub-pixel area SPXA1) of the first sub-pixel SPXL1 in a plan view. For example, the first wavelength conversion pattern WCP1 may be disposed in a space defined by the light blocking layer LBL and may overlap the first sub-pixel area SPXA1 in a plan view.

According to an embodiment, the light blocking layer LBL may include walls, and the first wavelength conversion pattern WCP1 may be provided in a space between the walls disposed in an area corresponding to the first sub-pixel SPXL1.

The second wavelength conversion pattern WCP2 may overlap the emission area EMA (e.g., second sub-pixel area SPXA2) of the second sub-pixel SPXL2 in a plan view. For example, the second wavelength conversion pattern WCP2 may be disposed in a space defined by the light blocking layer LBL and may overlap the second sub-pixel area SPXA2 in a plan view.

According to an embodiment, the light blocking layer LBL may include the walls, and the second wavelength conversion pattern WCP2 may be provided in a space between the walls disposed in an area corresponding to the second sub-pixel SPXL2.

The light transmission pattern LTP may overlap the emission area EMA (e.g., third sub-pixel area SPXA3) of the third sub-pixel SPXL3 in a plan view. For example, the light transmission pattern LTP may be disposed in a space defined by the light blocking layer LBL and may overlap the third sub-pixel area SPXA3 in a plan view.

According to an embodiment, the light blocking layer LBL may include the walls, and the light transmission pattern LTP may be provided in a space between the walls disposed in an area corresponding to the third sub-pixel SPXL3.

According to an embodiment, the first wavelength conversion pattern WCP1 may include first color conversion particles that convert the light of the third color emitted from the light emitting element LD into light of a first color. For example, in case that the light emitting element LD is a blue light emitting element emitting blue light and the first sub-pixel SPXL1 is a red pixel, the first wavelength conversion pattern WCP1 may include a first quantum dot that converts the blue light emitted from the blue light emitting element into red light.

For example, the first wavelength conversion pattern WCP1 may include first quantum dots dispersed in a matrix material such as a base resin. The first quantum dot may absorb the blue light and shift a wavelength according to an energy transition to emit the red light. In case that the first sub-pixel SPXL1 is a pixel PXL (e.g., refer to FIG. 1) of a different color, the first wavelength conversion pattern WCP1 may include a first quantum dot corresponding to the color of the first sub-pixel SPXL1.

According to an embodiment, the second wavelength conversion pattern WCP2 may include second color conversion particles that convert the light of the third color emitted from the light emitting element LD into light of a second color. For example, in case that the light emitting element LD is the blue light emitting element emitting the blue light and the second sub-pixel SPXL2 is a green pixel, the second wavelength conversion pattern WCP2 may include a second quantum dot that converts the blue light emitted from the blue light emitting element into a green light.

For example, the second wavelength conversion pattern WCP2 may include second quantum dots dispersed in a matrix material such as a base resin. The second quantum dot may absorb the blue light and shift a wavelength according to an energy transition to emit the green light. In case that the second sub-pixel SPXL2 is a pixel PXL (e.g., refer to FIG. 1) of a different color, the second wavelength conversion pattern WCP2 may include a second quantum dot corresponding to the color of the second sub-pixel SPXL2.

Each of the first quantum dot and the second quantum dot may have a form of a spherical, pyramidal, multi-arm, or cubic nano particle, a nano tube, a nano wire, a nano fiber, a nano plate particle, or the like. However, the disclosure is not limited thereto, and a shape of the first quantum dot and the second quantum dot may be variously changed.

In an embodiment, an absorption coefficient of the first quantum dot and the second quantum dot may be increased by causing the blue light having a relatively short wavelength in a visible light region to be incident on the first quantum dot and the second quantum dot. Accordingly, efficiency of the light emitted from the first sub-pixel SPXL1 and the second sub-pixel SPXL2 may be increased, and excellent color reproducibility may be secured. A pixel part of the first to third sub-pixels SPXL1, SPXL2, and SPXL3 using the light emitting elements LD (e.g., blue light emitting elements) may be configured as a same color, and manufacturing efficiency of the display device may be increased.

According to an embodiment, the light transmission pattern LTP may efficiently use the light of the third color emitted from the light emitting element LD. For example, in case that the light emitting element LD is the blue light emitting element emitting the blue light and the third sub-pixel SPXL3 is a blue pixel, the light transmission pattern LTP may include at least one type of light scattering particles to efficiently use the light emitted from the light emitting element LD.

For example, the light transmission pattern LTP may include the light scattering particles dispersed in a matrix material such as a base resin. For example, the light transmission pattern LTP may include light scattering particles such as silica, but a configuration material of the light scattering particles is not limited thereto.

The light scattering particles may not have to be disposed only in the third sub-pixel area SPXA3 in which the third sub-pixel SPXL3 is formed. For example, the light scattering particles may be selectively included in the first wavelength conversion pattern WCP1 and/or the second wavelength conversion pattern WCP2.

The light blocking layer LBL may be disposed on the display element part DPL. For example, the light blocking layer LBL may be disposed on the substrate SUB. The light blocking layer LBL may be disposed between the first passivation layer PSS1 and the second passivation layer PSS2. The light blocking layer LBL may surround the first wavelength conversion pattern WCP1, the second wavelength conversion pattern WCP2, and the light transmission pattern LTP at a boundary between adjacent ones of the sub-pixels SPXL.

According to an embodiment, the light blocking layer LBL may define the emission area EMA and a non-emission area NEA of the sub-pixel SPXL. The light blocking layer LBL may define the first to third sub-pixel areas SPXA1, SPXA2, and SPXA3.

For example, the light blocking layer LBL may not overlap the emission area EMA in a plan view. The light blocking layer LBL may overlap the non-emission area NEA in a plan view. An area in which the light blocking layer LBL is not disposed may be defined as the emission areas EMA of the first to third sub-pixels SPXL1, SPXL2, and SPXL3. The emission area EMA of the first sub-pixel SPXL1 may be the first sub-pixel area SPXA1, the emission area EMA of the second sub-pixel SPXL2 may be the second sub-pixel area SPXA2, and the emission area EMA of the third sub-pixel SPXL3 may be the third sub-pixel area SPXA3.

According to an embodiment, the light blocking layer LBL may be formed of an organic material including at least one of graphite, carbon black, black pigment, and black dye, or may be formed of a metal material including chromium (Cr), but is not limited thereto. The light blocking layer LBL may include various materials capable of blocking and absorbing light.

The second passivation layer PSS2 may be disposed between the color filter part CFL and the light blocking layer LBL. The second passivation layer PSS2 may seal (or cover) the first wavelength conversion pattern WCP1, the second wavelength conversion pattern WCP2, and the light transmission pattern LTP. The second passivation layer PSS2 may include any one of the above-described materials that may be used to form the insulating layer INF, e.g., as discussed herein, but is not limited thereto.

According to an embodiment, the color filter part CFL may be disposed on the color conversion part CCL. The color filter part CFL may include a color filter CF and a planarization layer PLA. The color filter CF may include a first color filter CF1, a second color filter CF2, and a third color filter CF3.

According to an embodiment, the color filter CF may be disposed on the second passivation layer PSS2. The color filter CF may overlap the emission areas EMA of the first to third sub-pixels SPXL1, SPXL2, and SPXL3 in a plan view.

For example, the first color filter CF1 may be disposed in the first sub-pixel area SPXA1, the second color filter CF2 may be disposed in the second sub-pixel area SPXA2, and the third color filter CF3 may be disposed in the third sub-pixel area SPXA3.

According to an embodiment, the first color filter CF1 may transmit the light of the first color, and may not transmit the light of the second color or the light of the third color. For example, the first color filter CF1 may block the light of the second color and the light of the third color. For example, the first color filter CF1 may include a colorant related to the first color.

According to an embodiment, the second color filter CF2 may transmit the light of the second color, and may not transmit the light of the first color or the light of the third color. For example, the second color filter CF2 may block the light of the first color and the light of the third color. For example, the second color filter CF2 may include a colorant related to the second color.

According to an embodiment, the third color filter CF3 may transmit the light of the third color, and may not transmit the light of the first color or the light of the second color. For example, the third color filter CF3 may block the light of the first color and the light of the second color. For example, the third color filter CF3 may include a colorant related to the third color.

According to an embodiment, the planarization layer PLA may be disposed on the color filter CF. The planarization layer PLA may cover (or overlap in a plan view) the color filter CF. The planarization layer PLA may offset (or planarize) a step difference (or height or thickness difference) generated due to the color filter CF.

According to an example, the planarization layer PLA may include an organic insulating material. However, the disclosure is not limited thereto, and the planarization layer PLA may include an inorganic material that may be used to form the insulating layer INF, e.g., as discussed herein.

A structure of each of the first to third sub-pixels SPXL1, SPXL2, and SPXL3 is not limited to the contents described above with reference to FIG. 5, and various structures may be appropriately selected to provide the display device DD according to an embodiment. For example, according to an embodiment, the display device DD may further include a low refractive index layer to improve light efficiency.

FIG. 6A is a schematic diagram illustrating the light emitting elements disposed in the pixel. FIG. 6B is a schematic diagram illustrating a defect rate of the light emitting element.

Referring to FIGS. 5 and 6A, a position of the first to third sub-pixels SPXL1, SPXL2, and SPXL3 (and/or first to third sub-pixel areas SPXA1, SPXA2, and SPXA3) may be defined by the light blocking layer LBL. For example, an area in which the light blocking layer LBL is not disposed may be the emission area EMA. The light emitted from the first to third sub-pixels SPXL1, SPXL2, and SPXL3 may be provided to the outside through the emission area EMA. An area in which the light blocking layer LBL is disposed may be the non-emission area NEA. The light emitted from the first to third sub-pixels SPXL1, SPXL2, and SPXL3 may not substantially provided to the outside.

According to an embodiment, the light blocking layer LBL may include a first opening OP1, a second opening OP2, and a third opening OP3. The first opening OP1, the second opening OP2, and the third opening OP3 may be disposed in an area in which the light blocking layer LBL is not disposed. According to an example, a position of the first opening OP1 may correspond to the first sub-pixel area SPXA1, a position of the second opening OP2 may correspond to the second sub-pixel area SPXA2, and a position of the third opening OP3 may correspond to the third sub-pixel area SPXA3.

At least a portion of the light blocking layer LBL may surround an area (e.g., emission area EMA or first sub-pixel area SPXA1) in which the first sub-pixel SPXL1 is provided to form the first opening OP1. The first sub-pixel area SPXA1 may be defined in the first opening OP1. The first sub-pixel area SPXA1 may be an area in which the first sub-pixel SPXL1 is disposed, and may mean (or correspond to) the emission area EMA of the first sub-pixel SPXL1.

According to an embodiment, the first wavelength conversion pattern WCP1 including a first wavelength conversion material may be disposed at the position corresponding to the first opening OP1. Accordingly, the light emitted from the light emitting element LD included in the first sub-pixel SPXL1 may be provided as the light having the first color and output to the outside.

At least a portion of the light blocking layer LBL may surround an area (e.g., emission area EMA or second sub-pixel area SPXA2) to be provided as the second sub-pixel SPXL2 to form the second opening OP2. The second sub-pixel area SPXA2 may be defined in the second opening OP2. The second sub-pixel area SPXA2 may be an area in which the second sub-pixel SPXL2 is disposed, and may mean (or correspond to) the emission area EMA of the second sub-pixel SPXL2.

According to an embodiment, the second wavelength conversion pattern WCP2 including a second wavelength conversion material may be disposed at a position corresponding to the second opening OP2. Accordingly, the light emitted from the light emitting element LD included in the second sub-pixel SPXL2 may be provided as the light having the second color and output to the outside.

At least a portion of the light blocking layer LBL may surround an area (e.g., emission area EMA or third sub-pixel area SPXA3) to be provided as the third sub-pixel SPXL3 to form the third opening OP3. The third sub-pixel area SPXA3 may be defined in the third opening OP3. The third sub-pixel area SPXA3 may be an area in which the third sub-pixel SPXL3 is disposed, and may mean (or correspond to) the emission area EMA of the third sub-pixel SPXL3.

According to an embodiment, the light transmission pattern LTP may be disposed at a position corresponding to the third opening OP3. Accordingly, the light emitted from the light emitting element LD included in the third sub-pixel SPXL3 may be provided as the light having the third color and output to the outside.

According to an embodiment, the first to third sub-pixels SPXL1, SPXL2, and SPXL3 may be spaced apart from each other in a first direction DR1. The first to third sub-pixel areas SPXA1, SPXA2, and SPXA3 may be spaced apart from each other in the first direction DR1.

According to an example, the first sub-pixel area SPXA1 may be disposed on a side of the second sub-pixel area SPXA2, and the third sub-pixel area SPXA3 may be disposed on another side of the second sub-pixel area SPXA2.

According to an embodiment, the first to third sub-pixels SPXL1, SPXL2, and SPXL3 may extend in a second direction DR2 and may be arranged in the first direction DR1. The first direction DR1 and the second direction DR2 may cross each other. For example, the first direction DR1 may intersect the second direction DR2. The first direction DR1 and the second direction DR2 may be non-parallel to each other. According to an example, the first direction DR1 and the second direction DR2 may be orthogonal to each other.

Multiple light emitting elements LD may be disposed in each of the first sub-pixel area SPXA1, the second sub-pixel area SPXA2, and the third sub-pixel area SPXA3. For example, the light emitting elements LD may be disposed in a regular distance (e.g., constant distance) along the second direction DR2 and may be alternately disposed in a zigzag shape. However, a disposition (or arrangement) of the light emitting element LD is not limited thereto, and may be disposed in various shapes. For example, the light emitting elements LD may be disposed according to a matrix shape defined in a row direction extending in the first direction DR1 and a column direction extending in the second direction DR2. The first direction DR1 and the second direction DR2 may intersect each other. The first direction DR1 and the second direction DR2 may be non-parallel to each other. According to an embodiment, the first direction DR1 and the second direction DR2 may be orthogonal to each other.

The light emitting element LD may have a circular shape in a plan view. For example, in case that the light emitting element LD is provided in a column shape having a bottom surface of a circular shape, the light emitting element LD may be provided in the circular shape in a plan view. However, the shape of the light emitting element LD is not limited thereto, and the light emitting element LD may have a quadrangular shape (or square shape) in a plan view. For example, in case that the light emitting element LD has the quadrangular shape, the light emitting element LD may be provided in a quadrangular shape (or square shape) in a plan view.

According to an embodiment, the number of light emitting elements LD per unit area on the substrate SUB may be uniform. The number of light emitting elements LD disposed in the first to third sub-pixel areas SPXA1, SPXA2, and SPXA3 per unit area may be generally uniform. For example, the light emitting elements LD may include a first light emitting elements disposed in the first sub-pixel area SPXA1, a second light emitting elements disposed in the second sub-pixel area SPXA2, and a third light emitting elements disposed in the third sub-pixel area SPXA3. The number of each of the first light emitting elements, the second light emitting elements, and the third light emitting elements may be substantially the same or equal to or less than a difference (or difference range). In FIGS. 6A and 6B, the number of light emitting elements LD per unit area may be ten as an example for convenience of description. However, the disclosure is not limited thereto.

In all of the light emitting elements LD shown in FIG. 6A, an inside of a circular shape representing the light emitting element LD is filled with black (or shading). In a case in which the inside of the circular shape is filled with black (or shading), the light emitting element LD may normally emit light.

Referring to FIG. 6B, some of the light emitting elements LD disposed in the first sub-pixel area SPXA1, the second sub-pixel area SPXA2, and the third sub-pixel area SPXA3 have a the circular shape, and an inside thereof is not filled with black (or shading). In case that the inside of the circular shape is not filled with black (or shading), the light emitting element LD may not emit light as a defect. For example, all ten light emitting elements LD disposed in the first sub-pixel area SPXA1 has a circular shape, and an inside thereof is filled with black (or shading). Thus, the all ten light emitting elements LD in the first sub-pixel area SPXA1 may normally emit light. For example, five light emitting elements LD among ten light emitting elements LD disposed in the second sub-pixel area SPXA2 have a circular shape, and an inside thereof is not filled with black (or shading). Thus, only five light emitting elements LD in the second sub-pixel area SPXA2 may normally emit light. For example, nine light emitting elements LD among ten light emitting elements LD disposed in the third sub-pixel area SPXA3 may have the circular shape, and an inside thereof may not be filled with black (or shading). Thus, only one light emitting element LD in the third sub-pixel area SPXA3 may normally emit light.

In case that at least one of the light emitting elements LD disposed in each of the first sub-pixel area SPXA1, the second sub-pixel area SPXA2, and the third sub-pixel area SPXA3 emits light (or in case that at least one of the light emitting elements LD disposed in each of the first sub-pixel area SPXA1, the second sub-pixel area SPXA2, and the third sub-pixel area SPXA3 is not defective), each of the first sub-pixel SPXL1, the second sub-pixel SPXL2, and the third sub-pixel SPXL3 may not be regarded as a sub-pixel defective state. However, as the number of light emitting elements LD that do not emit light among the light emitting elements LD disposed in each of the first sub-pixel area SPXA1, the second sub-pixel area SPXA2, and the third sub-pixel area SPXA3 increases, a luminance of the sub-pixel SPXL corresponding to the same data signal may decrease. For example, the luminance corresponding to the same data signal may decrease in an order of the first sub-pixel SPXL1, the second sub-pixel SPXL2, and the third sub-pixel SPXL3 shown in FIG. 6B. In FIG. 6B, the luminance of the first sub-pixel SPXL1 may be greater than the luminance of the second sub-pixel SPXL2, and the luminance of the second sub-pixel SPXL2 may be greater than the luminance of the third sub-pixel SPXL3.

Hereinafter, a method of sensing a defect rate of the light emitting elements LD and compensating for a reduced luminance of the sub-pixel SPXL (or display panel 100) in response to the defect rate are described with reference to FIGS. 7 to 10.

Figure 8A:
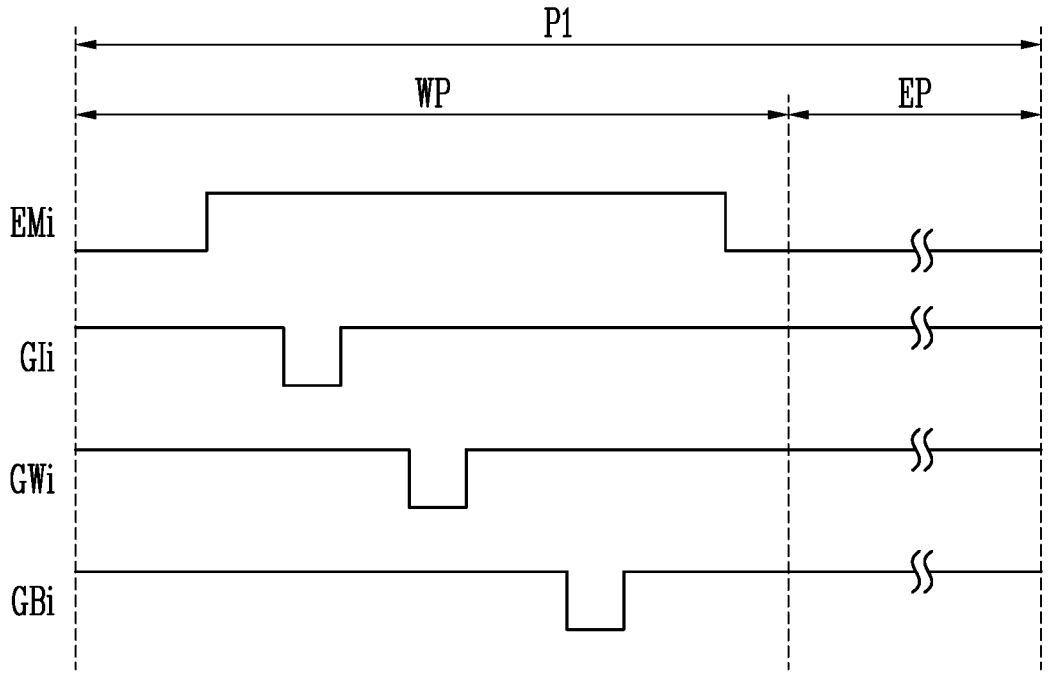
FIG. 8A is a schematic signal diagram illustrating an operation of an active period.
Figure 8B:
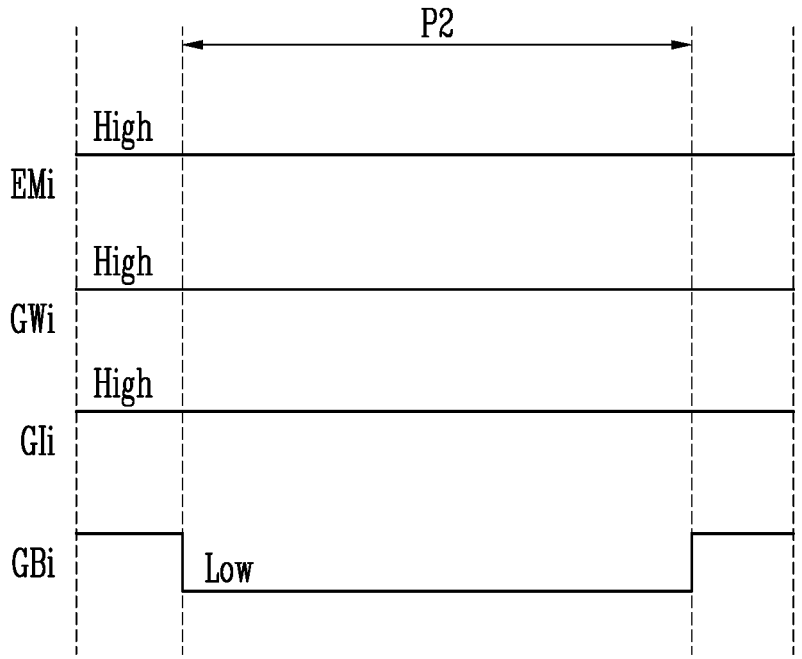
FIG. 8B is a schematic signal diagram illustrating an operation of a current sensing period.

FIG. 7 is a schematic diagram illustrating a current sensing circuit according to an embodiment. FIG. 8A is a schematic signal diagram illustrating an operation of an active period. FIG. 8B is a schematic signal diagram illustrating an operation of a current sensing period. FIG. 9 is a schematic lookup table including a compensation value of second power corresponding to a defect rate of a display panel according to an embodiment. The current sensing period shown in FIG. 8B may be included in a vertical blank period existing between the active periods. However, the disclosure is not limited thereto. For example, the current sensing period may be included in a period in which the display device DD of FIG. 1 is turned on/off.

Referring to FIGS. 6A, 7, and 8A, the emission control signal EMi of the gate-off voltage (e.g., a logic high level) may be supplied to the i-th emission control line Ei during a scan period WP. Therefore, during the scan period WP, the fifth and sixth transistors T5 and T6 may be turned off.

The second scan signal GIi of the gate-on voltage (or logical low level) may be supplied to the 2i-th scan line S2*i*. Accordingly, the fourth transistor T4 may be turned on, and the gate electrode of the first transistor T1 may be electrically connected to the initialization power VINT. Accordingly, a voltage of the gate electrode of the first transistor T1 may be initialized to the voltage of the initialization power VINT and may be maintained by the storage capacitor Cst. For example, the voltage of the initialization power VINT may be sufficiently lower than the voltage of the first power VDD. For example, the voltage of the initialization power VINT may be the same as or similar to the voltage of the second power VSS. Therefore, the first transistor T1 may be turned on.

The first scan signal GWi of the gate-on voltage (or logical low level) may be supplied to the 1i-th scan line S1*i*, and the second and third transistors T2 and T3 corresponding to the first scan signal GWi may be turned on. Accordingly, a data voltage corresponding to a grayscale value of the sub-pixel SPXL applied to the j-th data line Dj may be written to (or stored in) the storage capacitor Cst through the transistors T2, T1, and T3. The data voltage written to (or stored in) the storage capacitor Cst may be a voltage in which a decrease of the threshold voltage of the first transistor T1 is reflected (or applied). For example, the data voltage written to (or stored in) the storage capacitor Cst may be decreased from the data voltage applied to the j-th data line Dj by the decrease of the threshold voltage of the first transistor T1.

The third scan signal GBi of the gate-on voltage (or low level) may be supplied to the 3i-th scan line S3*i*, and the seventh transistor T7 may be turned on. The eighth transistor T8 may be turned off. Therefore, the voltage of the anode Ea of the light emitting element LD (or second node N2) may be initialized.

Thus, in case that the emission control signal EMi becomes the gate-on voltage (or logical low level), the transistors T5 and T6 may be turned on. In the sub-pixel SPXL shown in FIG. 7, since the third scan signal GBi maintains a logic high level, the third scan signal GBi passing through an inverter INV may be at a logic low level. Thus, the eighth Transistor T8 may be turned on. In the sub-pixel SPXL_1 shown in FIG. 10, since the third scan signal GBi maintains a logic high level, the N-type eighth transistor T8 may be turned on. Accordingly, a driving current ID path electrically connected to the first power VDD, the transistors T5, T1, T6, and T8, the light emitting element LD, and the second power VSS may be formed, and the driving current ID may flow therethrough.

An amount of the driving current ID may correspond to the data voltage stored in the storage capacitor Cst. Since the driving current ID flows through the first transistor T1, the decrease of the threshold voltage of the first transistor T1 is reflected therein. Accordingly, since the decrease of the threshold voltage reflected in the data voltage stored in the storage capacitor Cst and the decrease of the threshold voltage reflected in the driving current ID offset (or compensate) each other, the driving current ID corresponding to the data voltage may flow regardless of a value of the threshold voltage of the first transistor T1. According to the amount of the driving current ID, the light emitting element LD may emit light with a targeted luminance. However, differently from that shown in FIG. 6A, in case that at least one of the light emitting elements LD disposed in the sub-pixel area SPXA does not normally operate and some of the light emitting elements LD are defective, the driving current ID may decrease, and the display panel 100 may emit light with a luminance lower than a target luminance.

Referring to FIGS. 6B and 7, the driving current ID flowing between the second node N2 and the anode Ea of the light emitting element LD may correspond to the defect rate of the light emitting elements LD disposed in each of the first sub-pixel area SPXA1, the second sub-pixel area SPXA2, and the third sub-pixel area SPXA3.

The defect rate of each sub-pixel area SPXA (or the defect rate of the light emitting element LD disposed in each sub-pixel area SPXA) may be calculated using Equation 1 below.

$$ER[\%] = \left(1 - \frac{IS}{ILD * N}\right) * 100 \quad \text{[Equation 1]}$$

(ER is the defect rate of each sub-pixel area, ILD is an amount of current flowing through each light emitting element, N is the number of light emitting elements disposed in each sub-pixel area, and IS is a sensing current amount of each sub-pixel).

Since a maximum amount of current that may flow through each of the light emitting elements LD is limited to a preset value, the sensing current IS of the sub-pixel SPXL may be proportional to the number of light emitting elements LD that normally emit light among the light emitting elements LD disposed in each sub-pixel area SPXA. For example, since all ten of the light emitting elements LD disposed in the first sub-pixel area SPXA1 of FIG. 6B normally emit light, five light-emitting elements LD disposed in the second sub-pixel area SPXA2 normally emit light, and one light emitting element LD disposed in the third sub-pixel area SPXA3 normally emits light, a ratio of the sensing current amounts IS of each of the first sub-pixel area SPXA1, the second sub-pixel area SPXA2, and the third sub-pixel area SPXA3 may be 10:5:1.

In case that all light emitting elements LD disposed in each sub-pixel area SPXA normally emit light, since a current amount obtained by multiplying the number N of light emitting elements LD disposed in each sub-pixel area SPXA by the current amount ILD flowing through the one light emitting element LD may be equal to the sensing current amount IS flowing through the all light emitting elements LD disposed in the sub-pixel area SPXA, the defect rate of the first sub-pixel area SPXA1 may be 0%. As described above, since the ratio of the sensing current amount IS of each of the first sub-pixel area SPXA1, the second sub-pixel area SPXA2, and the third sub-pixel area SPXA3 is 10:5:1, the defect rates of the second sub-pixel area SPXA2 and the third sub-pixel area SPXA3 may be calculated as 50% and 90%, respectively. For example, five light emitting elements LD may be defective and remaining five light emitting elements LD may normally emit the light in the second sub-pixel area SPXA2. Nine light emitting elements LD may be defective and remaining one light emitting element LD may normally emit the light in the third sub-pixel area SPXA3.

As described above, in order to calculate the defect rate of each sub-pixel area SPXA, the current sensing circuit ISC may be disposed between the second node N2 and the anode Ea of the light emitting element LD. The current sensing circuit ISC according to an embodiment may include the eighth transistor T8 (or sensing transistor), the resistor R, the load LOAD, the amplifier AMP, and the inverter INV.

However, an embodiment of the current sensing circuit ISC is not limited thereto. For example, the eighth transistor T8 (or sensing transistor), the resistor R, the load LOAD, and the inverter INV may be formed in the pixel circuit PXC, and the amplifier AMP may be formed in the compensator 700.

The eighth transistor T8 may be disposed between the second node N2 and the anode Ea of the light emitting element LD, and a gate electrode of the eighth transistor T8 may be electrically connected to an output terminal of the inverter INV.

An end of the inverter INV may be electrically connected to the 3i-th scan line S3*i* (or gate electrode of the seventh transistor T7), and another end of the inverter INV may be electrically connected to the gate electrode of the eighth transistor T8. The inverter INV may invert a signal provided through the 3i-th scan line S3*i*. For example, in case that the signal provided through the 3i-th scan line S3*i* is a logic low level, a signal passing through the inverter INV may be changed to a logic high level. On the contrary, in case that the signal provided through the 3i-th scan line S3*i* is a logic high level, the signal passing through the inverter INV may be changed to a logic low level.

The resistor R and the load LOAD may be electrically connected in series, and the resistor R and the load LOAD may be electrically connected in parallel with the eighth transistor T8. For example, the resistor R and the load LOAD may be electrically connected in series between the second node N2 and the anode Ea of the light emitting element LD. The load LOAD may be a resistance element, and a resistance value of the load LOAD may be greater than a resistance value of the resistor R. The resistance value of the resistor R and the resistance value of the load LOAD may be changed according to a specification (e.g., electrical properties) of the amplifier AMP.

A non-inverting terminal and an inverting terminal of the amplifier AMP may be electrically connected to both ends of the resistor R, respectively. According to an embodiment, the amplifier AMP may be a differential amplifier, and may output a potential difference between the both ends of the resistor R as an output signal Vout through an output terminal. The output signal Vout may be provided to the compensator 700. The amplifier AMP may receive a driving power VCC through a power supply terminal. The output signal Vout may be formed between the driving power VCC and a ground power (or ground potential).

Referring to FIGS. 7 and 8B, during a current sensing period P2, the emission control signal EMi, the first scan signal GWi, and the second scan signal GIi may be a gate-off voltage (e.g., logic high level), and the third scan signal GBi may be a gate-on voltage (e.g., logic low level).

Therefore, among the transistors T1 to T8 included in the pixel circuit PXC during the current sensing period P2, all of the remaining transistors T1 to T6 and T8 except for the seventh transistor T7 may be turned off. In case that the seventh transistor T7 is turned on, the voltage of the anode initialization power VAINT may be provided to the second node N2, and the gate electrode of the eighth transistor T8 may receive the third scan signal GBi having a gate-off voltage (e.g., logic high level) passing through the inverter INV. For example, the inverter INV may change the gate-on voltage of the third scan signal GBi into the gate-off voltage of the third scan signal GBi, and the gate-off voltage may be applied to the gate electrode of the eighth transistor T8. Thus, the eighth transistor T8 may be turned off. Therefore, the sensing current IS may flow through the resistor R.

The amplifier AMP may output the potential difference between the both ends of the resistor R as the output signal Vout through the output terminal thereof in response to the sensing current IS flowing through the both ends of the resistor R. The output signal Vout may be provided to the compensator 700. The compensator 700 may calculate the sensing current IS based on the output signal Vout through Ohm's law.

As described above, in the current sensing circuit ISC, the resistor R and the load LOAD may not be directly disposed in the path between the second node N2 and the anode Ea of the light emitting element LD, but bypassed from the path between the second node N2 and the anode Ea of the light emitting element LD. Thus, a luminance change of the light emitting element LD due to the resistance R and the load LOAD may be prevented while the light emitting element LD emits light.

The defect rate of each sub-pixel area may be described with reference to FIGS. 7, 8A, and 8B. Similarly to this, the defect rate of the display panel 100 (or defect rate of all light emitting elements LDs disposed in display panel 100) may be calculated using Equation 2 below.

$$ER'[\%] = \left(1 - \frac{IS'}{ILD * N'}\right) * 100 \quad \text{[Equation 2]}$$

(ER' is a defect rate of the display panel, ILD is the amount of current flowing through each light emitting element, N' is the number of light emitting elements disposed in the display panel, and IS' is a sum of a sensing current amount of the sub-pixels included in the display panel)

The compensator 700 may receive the output signal Vout from all sub-pixels SPXL included in the display panel 100 (e.g., refer to FIG. 1). The compensator 700 may calculate the sum of the sensing current amounts IS' of all sub-pixels SPXL included in the display panel 100 (e.g., refer to FIG. 1), based on the output signal Vout through Ohm's law. Thereafter, the compensator 700 may calculate the defect rate ER' of the display panel 100 (e.g., refer to FIG. 1) based on Equation 2 above.

Referring to FIGS. 7 and 9, the compensator 700 may include a lookup table LUT that matches a compensation value VSS' of the second power to the defect rate ER' of the display panel 100 (e.g., refer to FIG. 1). For example, in case that the defect rate ER' of the display panel 100 (e.g., refer to FIG. 1) is 0%, the compensation value VSS' of the second power may be 0. In case that the defect rates ER' of the display panel 100 (e.g., refer to FIG. 1) are 1%, 2%, 3%, 4%, 5%, and 6%, the compensation values VSS' of the second power may be −0.01V, −0.02V, −0.03V, −0.04V, −0.05V, −0.06V, and −0.07V, respectively.

A value of the lookup table LUT shown in FIG. 9 is example and is not limited thereto. According to an embodiment, the compensation value VSS' of the second power corresponding to the defect rate ER' of the display panel 100 (e.g., refer to FIG. 1) may be experimentally calculated by measuring a luminance value of the display panel 100 (e.g., refer to FIG. 1) corresponding to the defect rate ER' of the display panel 100 (e.g., refer to FIG. 1).

For example, referring to Table 1 below, in case that the defect rate ER' of the display panel is 0%, a luminance of the display panel 100 may be 1,000 nits. In case that the defect rate ER' of the display panel 100 (e.g., refer to FIG. 1) increases from 1% to 7%, the luminance of the display panel 100 may linearly decrease from 990 nits to 930 nits. In case that any one of −0.01V to −0.07V is applied to the second power VSS as the compensation value VSS' of the second power (e.g., compensation value VSS' of second power VSS is added to second power VSS), a difference value between the voltage of the first power VDD and the voltage of the second power VSS may increase, and thus the luminance of the display panel 100 may increase.

However, in case that the defect rate ER' of the display panel 100 (e.g., refer to FIG. 1) is equal to or greater than a preset value in an inspection (e.g., inspection performed before shipment of the display device DD), the display device DD (e.g., refer to FIG. 1) may be determined as a defective product, which may be discarded. For example, in case that the defect rate ER' of the display panel is 6% or more, the display device DD may be determined as a defective product.

TABLE 1

| ER'(%) | Luminance(nit) | VSS'(V) |
|---|---|---|
| 0 | 1000 | 0 |
| 1 | 990 | −0.01 |
| 2 | 980 | −0.02 |
| 3 | 970 | −0.03 |
| 4 | 960 | −0.04 |
| 5 | 950 | −0.05 |
| 6 | 940 | −0.06 |
| 7 | 930 | −0.07 |
| ~ | ~ | ~ |

The compensator 700 may provide a compensation value VSS' of the second power corresponding to the calculated defect rate ER' of the display panel 100 (e.g., refer to FIG. 1) to the power supply 500 (e.g., refer to FIG. 1). The power supply 500 (e.g., refer to FIG. 1) may provide the display panel 100 (e.g., refer to FIG. 1) with changed second power VSS by reflecting (or compensating) the compensation value VSS' of the second power to the voltage of the second power VSS. For example, the driving current ID flowing through the light emitting element LD in an emission period P1 may be proportional to the difference value between the first power VDD and the second power VSS. In case that the voltage of the second power VSS is decreased in response to the defect rate ER' of the display panel, the driving current ID flowing through the light emitting element LD may increase. Thus, the luminance of the display panel 100 may increase.

As described above, in response to the defect rate ER' of the display panel 100 (e.g., refer to FIG. 1), the compensation value VSS' of the second power may be reflected to (or may compensate) the second power VSS provided to the display panel 100 (e.g., refer to FIG. 1). Thus, the luminance of the display device DD may be maintained as the target luminance.

In FIG. 1, the compensator 700 may provide (e.g., directly provide) the compensation value VSS' of the second power to the power supply 500, but the disclosure is not limited thereto. For example, the compensator 700 may provide the compensation value VSS' of the second power to the timing controller 600, and the timing controller 600 may change a value of the second power VSS provided from the power supply 500, through the fourth control signal PCS.

Hereinafter, other embodiments are described. In the following embodiment, detailed descriptions of the same constituent elements are omitted or simplified, and differences are described.

FIG. 10 is a schematic diagram illustrating a current sensing circuit according to another embodiment.

The current sensing circuit ISC_1 of FIG. 10 is different from the current sensing circuit ISC of FIG. 7 including the inverter INV and the eighth transistor T8 of a P-type, at least in that the inverter INV is omitted and the eighth transistor T8 is an N-type. Hereinafter, the disclosure is described based on the eighth transistor T8.

Referring to FIGS. 7, 8B, and 10, a sensing current circuit ISC_1 may be disposed between a second node N2 and an anode Ea of a light emitting element LD. The current sensing circuit ISC_1 according to an embodiment may include the eighth transistor T8 (or current sensing transistor), a resistor R, a load LOAD, and an amplifier AMP.

However, an embodiment of the current sensing circuit ISC_1 is not limited thereto. For example, the eighth transistor T8 (or sensing transistor), the resistor R, and the load LOAD may be formed in a pixel circuit PXC, and the amplifier AMP may be formed in a compensator 700.

The eighth transistor T8 may be disposed between the second node N2 and the anode Ea of the light emitting element LD, and a gate electrode of the eighth transistor T8 may be electrically connected to a 3i-th scan line S3*i*.

Since both of a gate electrode of a seventh transistor T7 and the gate electrode of the eighth transistor T8 are electrically connected to the 3i-th scan line S3*i*, both of the gate electrode of the seventh transistor T7 and the gate electrode of the eighth transistor T8 may receive a third scan signal GBi through the 3i-th scan line S3*i*. The third scan signal GBi applied to the gate electrode of the seventh transistor T7 may have the same potential level as the third scan signal GBi applied to the gate electrode of the eighth transistor T8. Since the seventh transistor T7 is a P-type and the eighth transistor T8 is the N-type, the seventh transistor T7 and the eighth transistor T8 may alternately operate. For example, in case that the third scan signal GBi is a logic low level, the seventh transistor T7 may be turned on and the eighth transistor T8 may be turned off. Conversely, in case that the third scan signal GBi is a logic high level, the seventh transistor T7 may be turned off and the eighth transistor T8 may be turned on.

The resistor R and the load LOAD may be electrically connected in series, and the resistor R and the load LOAD may be electrically connected in parallel with the eighth transistor T8. For example, the resistor R and the load LOAD may be electrically connected in series between the second node N2 and the anode Ea of the light emitting element LD. The load LOAD may be a resistance element, and the resistance value of the load LOAD may be greater than the resistance value of the resistor R. The resistance value of the resistor R and the resistance value of the load LOAD may be changed according to the specification (e.g., electrical properties) of the amplifier AMP.

A non-inverting terminal and an inverting terminal of the amplifier AMP may be electrically connected to both ends of the resistor R, respectively. According to an embodiment, the amplifier AMP may be a differential amplifier, and may output a potential difference between the both ends of the resistor R as an output signal Vout through an output terminal. The output signal Vout may be provided to the compensator 700.

Referring to FIGS. 8B and 10, during a current sensing period P2, an emission control signal EMi, a first scan signal GWi, and a second scan signal GIi may be a gate-off voltage (e.g., logic high level), and the third scan signal GBi may be a gate-on voltage (e.g., logic low level).

Therefore, among the transistors T1 to T8 included in the pixel circuit PXC during the current sensing period P2, all of the remaining transistors T1 to T6 and T8 except for the seventh transistor T7 may be turned off. In case that the seventh transistor T7 is turned on, since the voltage of an anode initialization power VAINT is provided to the second node N2, and the eighth transistor T8 is turned off, the sensing current IS may flow through the resistor R.

The amplifier AMP may output the potential difference between the both ends of the resistor R as the output signal Vout through the output terminal thereof in response to the sensing current IS flowing through the both ends of the resistor R. The output signal Vout may be provided to the compensator 700.

As described above, by disposing the current sensing circuit ISC bypassed rather than directly disposing the resistor R and the load LOAD in the path between the second node N2 and the anode Ea of the light emitting element LD, a luminance change of the light emitting element LD due to the resistance R and the load LOAD may be prevented while the light emitting element LD emits light. Since the current sensing circuit ISC 1 of FIG. 10 may omit (or may not include) the inverter INV compared to the current sensing circuit ISC of FIG. 7, a circuit structure thereof may be simplified.

The compensator 700 may receive the output signal Vout from all sub-pixels SPXL included in the display panel 100 (e.g., refer to FIG. 1). The compensator 700 may calculate the sum of the sensing current amounts IS' of all sub-pixels SPXL included in the display panel 100 (e.g., refer to FIG. 1), based on the output signal Vout through Ohm's law. Thereafter, the compensator 700 may calculate a defect rate ER' of the display panel 100 (e.g., refer to FIG. 1) based on Equation 2 above.

The compensator 700 may include the lookup table LUT of FIG. 9 that matches a compensation value VSS' of a second power to the defect rate ER' of the display panel 100 (e.g., refer to FIG. 1).

As shown in FIG. 1, the compensator 700 may provide the compensation value VSS' of the second power corresponding to the calculated defect rate ER' of the display panel 100 to the power supply 500. The power supply 500 may provide the display panel 100 with the changed second power VSS by reflecting (or compensating) the compensation value VSS' of the second power to the voltage of the second power VSS. For example, since the driving current ID flowing through the light emitting element LD in the emission period P1 is proportional to the difference value between the first power VDD and the second power VSS in case that the voltage of the second power VSS is decreased in response to the defect rate ER' of the display panel, the driving current ID flowing through the light emitting element LD may increase. Thus, the luminance of the display panel 100 may increase.

As described above, in response to the defect rate ER' of the display panel 100, the compensation value VSS' of the second power may be reflected to the second power VSS provided to the display panel 100, and thus the luminance of the display device DD may be maintained as a target luminance.

Although the disclosure has been described with reference to the embodiments thereof, it will be understood by those skilled in the art that the disclosure may be variously modified and changed without departing from the spirit and scope of the disclosure.

What is claimed is:

1. A pixel comprising:

a light emitting element;

a first transistor disposed between a first power and a second node and including a gate electrode electrically connected to a first node;

a second transistor disposed between a data line and a first electrode of the first transistor and including a gate electrode electrically connected to a first scan line;

a third transistor disposed between the first node and a second electrode of the first transistor and including a gate electrode electrically connected to the first scan line;

a fourth transistor disposed between the first node and an initialization power and including a gate electrode electrically connected to a second scan line;

a seventh transistor disposed between the second node and an anode initialization power and including a gate electrode electrically connected to a third scan line;

an eighth transistor disposed between the second node and an anode of the light emitting element and including a gate electrode electrically connected to the third scan line;

a resistor electrically connected in parallel with the eighth transistor between the second node and the anode of the light emitting element; and an amplifier having a non-inverting terminal and an inverting terminal electrically connected to ends of the resistor, respectively.

2. The pixel according to claim 1, further comprising:

an inverter electrically connected between the gate electrode of the eighth transistor and the third scan line, wherein the seventh transistor and the eighth transistor are P-type transistors.

3. The pixel according to claim 1, wherein the seventh transistor is a P-type transistor, and the eighth transistor is an N-type transistor.

4. The pixel according to claim 1, wherein the light emitting element has a size in a range of a nano scale to a micro scale.

5. The pixel according to claim 1, further comprising:

a load disposed between the second node and the anode of the light emitting element, wherein the load is electrically connected in series with the resistor, and a resistance value of the load is greater than a resistance value of the resistor.

6. The pixel according to claim 1, further comprising:

a fifth transistor disposed between the first power and the first electrode of the first transistor and including a gate electrode electrically connected to an emission control line; and a sixth transistor disposed between the second electrode of the first transistor and the second node and including a gate electrode electrically connected to the emission control line.

7. The pixel according to claim 6, wherein during a sensing period, a first scan signal of a logic high level is provided through the first scan line, a second scan signal of a logic high level is provided through the second scan line, and a third scan signal of a logic low level is provided through the third scan line.

8. The pixel according to claim 1, wherein the amplifier is a differential amplifier that outputs a potential difference between the ends of the resistor as an output signal through an output terminal.

9. A display device comprising:

a display panel including a plurality of pixels;

a scan driver that provides a first scan signal, a second scan signal, and a third scan signal to the pixels;

a data driver that provides a data signal to the pixels;

a power supply that provides a first power and a second power to the pixels; and a timing controller that controls the scan driver and the data driver, wherein each of the pixels comprises:

a light emitting element;

a first transistor disposed between the first power and a second node and including a gate electrode electrically connected to a first node;

a second transistor disposed between a data line and a first electrode of the first transistor and including a gate electrode electrically connected to a first scan line;

a third transistor disposed between the first node and a second electrode of the first transistor and including a gate electrode electrically connected to the first scan line;

a fourth transistor disposed between the first node and an initialization power and including a gate electrode electrically connected to a second scan line;

a seventh transistor disposed between the second node and an anode initialization power and including a gate electrode electrically connected to a third scan line;

an eighth transistor disposed between the second node and an anode of the light emitting element and including a gate electrode electrically connected to the third scan line;

a resistor electrically connected in parallel with the eighth transistor between the second node and the anode of the light emitting element; and an amplifier having a non-inverting terminal and an inverting terminal electrically connected to ends of the resistor, respectively.

10. The display device according to claim 9, wherein the seventh transistor and the eighth transistor alternately operate.

11. The display device according to claim 10, further comprising:

an inverter electrically connected between the gate electrode of the eighth transistor and the third scan line, wherein the seventh transistor and the eighth transistor are transistors of a same type.

12. The display device according to claim 10, wherein the seventh transistor and the eighth transistor are transistors of different types.

13. The display device according to claim 9, further comprising:

a load disposed between the second node and the anode of the light emitting element, wherein the load is electrically connected in series with the resistor, and a resistance value of the load is greater than a resistance value of the resistor.

14. The display device according to claim 9, further comprising:

a fifth transistor disposed between the first power and the first electrode of the first transistor and including a gate electrode electrically connected to an emission control line; and a sixth transistor disposed between the second electrode of the first transistor and the second node and including a gate electrode electrically connected to the emission control line.

15. The display device according to claim 14, wherein during a sensing period, the first scan signal of a logic high level is provided through the first scan line, the second scan signal of a logic high level is provided through the second scan line, and the third scan signal of a logic low level is provided through the third scan line.

16. The display device according to claim 9, wherein the amplifier is a differential amplifier that outputs a potential difference between the ends of the resistor as an output signal through an output terminal.

17. The display device according to claim 16, further comprising:

a compensator that receives the output signal of the amplifier from each of the pixels, and calculates a sum of a sensing current amount flowing through the ends of the resistor based on the output signal.

18. The display device according to claim 17, wherein the compensator calculates a defect rate of the pixels according to Equation 1 below $$ER'[\%] = \left(1 - \frac{Is'}{ILD * N'}\right) * 100, \quad \text{[Equation 1]}$$

wherein ER' is a defect rate of a display panel, ILD is an amount of current flowing through each light emitting element, N is the number of light emitting elements disposed on the display panel, and IS' is a sum of a sensing current amount of sub-pixels included in the display panel.

19. The display device according to claim 18, wherein the compensator includes a lookup table matching a compensation value of the second power corresponding to the defect rate of the display panel, and the compensation value of the second power has a less value as the defect rate of the display panel increases.

20. The display device according to claim 19, wherein the power supply receives the compensation value of the second power from the compensator, and the power supply provides a value which is obtained by adding the compensation value of the second power to the second power, to the pixels.

* * * * *